US010480531B2

(12) United States Patent
Shibata et al.

(10) Patent No.: US 10,480,531 B2
(45) Date of Patent: Nov. 19, 2019

(54) AXIAL FLOW COMPRESSOR, GAS TURBINE INCLUDING THE SAME, AND STATOR BLADE OF AXIAL FLOW COMPRESSOR

(71) Applicant: Mitsubishi Hitachi Power Systems, Ltd., Nishi-ku, Yokohama (JP)

(72) Inventors: Takanori Shibata, Yokohama (JP); Naoto Omura, Yokohama (JP); Chihiro Myoren, Yokohama (JP); Yasuo Takahashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 567 days.

(21) Appl. No.: 15/220,451

(22) Filed: Jul. 27, 2016

(65) Prior Publication Data

US 2017/0030375 A1 Feb. 2, 2017

(30) Foreign Application Priority Data

Jul. 30, 2015 (JP) ..... 2015-150840

(51) Int. Cl.
*F01D 5/14* (2006.01)
*F04D 29/54* (2006.01)
(Continued)

(52) U.S. Cl.
CPC ..... *F04D 29/542* (2013.01); *F01D 5/143* (2013.01); *F01D 5/145* (2013.01); *F04D 19/02* (2013.01);
(Continued)

(58) Field of Classification Search
CPC ..... F01D 5/141; F01D 5/143; F01D 5/145; F04D 29/324; Y02T 50/673
See application file for complete search history.

(56) References Cited

U.S. PATENT DOCUMENTS 5,779,443 A * 7/1998 Haller ..... F01D 5/141 415/191
6,312,219 B1 11/2001 Wood et al.
(Continued)

FOREIGN PATENT DOCUMENTS

EP 2 133 573 A1 12/2009
JP 2001-132696 A 5/2001
JP 2004-68770 A 3/2004

OTHER PUBLICATIONS

Extended European Search Report issued in counterpart European Application No. 16180705.2 dated Dec. 13, 2016 (9 pages).
(Continued)

*Primary Examiner* — Carlos A Rivera
*Assistant Examiner* — Behnoush Haghighian
(74) *Attorney, Agent, or Firm* — Crowell & Moring LLP

(57) ABSTRACT

An axial flow compressor includes multiple rotor blade rows configured to include multiple rotor blades and multiple stator blade rows configured to include multiple stator blades, the multiple rotor blades and the multiple stator blades being arranged in an annular channel through which a working fluid flows. A portion of at least one wall surface on an inner peripheral side and an outer peripheral side of the annular channel, the portion being at an arrangement portion where at least any one blade row of the rotor blade rows and the stator blade rows is located, has a protruding portion such that downstream side part of the portion is curved so as to further protrude to the annular channel than upstream side part of the portion. Each blade of the blade row located at the protruding portion of the wall surface is configured such that an increase rate in a wall surface direction of a blade outlet angle in a blade end portion on the side of the wall surface having the protruding portion is
(Continued)

greater than an increase rate in the wall surface direction of a blade outlet angle in a blade height intermediate portion.

10 Claims, 10 Drawing Sheets

(51) Int. Cl.
*F04D 29/32* (2006.01)
*F04D 29/52* (2006.01)
*F04D 19/02* (2006.01)
*F04D 29/68* (2006.01)

(52) U.S. Cl.
CPC ..... *F04D 29/321* (2013.01); *F04D 29/324* (2013.01); *F04D 29/526* (2013.01); *F04D 29/544* (2013.01); *F04D 29/547* (2013.01); *F04D 29/681* (2013.01); *F04D 29/682* (2013.01); *F04D 29/684* (2013.01); *F01D 5/141* (2013.01); *F05D 2220/32* (2013.01); *F05D 2240/12* (2013.01); *F05D 2240/122* (2013.01); *F05D 2240/304* (2013.01); *F05D 2240/306* (2013.01); *F05D 2240/80* (2013.01); *F05D 2250/71* (2013.01); *F05D 2250/713* (2013.01)

(56) References Cited

U.S. PATENT DOCUMENTS 6,709,239 B2 * 3/2004 Chandraker ..... F01D 5/141 416/238
6,899,526 B2 * 5/2005 Doloresco ..... F01D 5/141 416/223 A
7,175,393 B2 * 2/2007 Chandraker ..... F01D 5/141 416/223 A
7,967,571 B2 * 6/2011 Wood ..... F01D 5/141 416/243
8,152,473 B2 * 4/2012 Clemen ..... F01D 5/141 416/241 R
8,157,518 B2 * 4/2012 Decker ..... F04D 29/384 415/211.2
8,167,548 B2 * 5/2012 Greim ..... F01D 5/141 415/193
8,292,574 B2 * 10/2012 Wood ..... F01D 5/142 415/199.5
8,337,154 B2 * 12/2012 Decker ..... F04D 25/0606 415/191
8,523,531 B2 * 9/2013 Micheli ..... F01D 5/141 416/223 A
8,678,757 B2 * 3/2014 Li ..... F04D 29/324 415/191
8,684,698 B2 * 4/2014 Breeze-Stringfellow ..... F01D 5/141 416/223 A
8,708,660 B2 * 4/2014 Micheli ..... F01D 5/141 416/238
8,747,072 B2 * 6/2014 Micheli ..... F01D 5/141 416/238
8,864,457 B2 * 10/2014 Malandra ..... F01D 5/141 415/191
9,017,037 B2 * 4/2015 Baltas ..... F01D 5/141 416/243
9,074,483 B2 * 7/2015 Breeze-Stringfellow ..... F01D 5/141
9,291,059 B2 * 3/2016 Micheli ..... F01D 5/141
9,464,526 B2 * 10/2016 Cellier ..... F01D 5/143
9,797,267 B2 * 10/2017 Lohaus ..... F01D 5/141
2004/0013520 A1 * 1/2004 Guemmer ..... F01D 5/142 415/199.5
2004/0028526 A1 2/2004 Teramura et al.
2009/0257866 A1 * 10/2009 Greim ..... F01D 5/141 415/208.1
2011/0081252 A1 * 4/2011 Li ..... F04D 29/324 416/241 R
2013/0136619 A1 * 5/2013 Passrucker ..... F01D 5/145 416/235
2013/0315739 A1 * 11/2013 Cellier ..... F01D 5/143 416/204 A

OTHER PUBLICATIONS

Korean-language Office Action issued in counterpart Korean Application No. 10-2016-0094055 dated May 1, 2018 (seven (7) pages).

* cited by examiner

AXIAL FLOW COMPRESSOR, GAS TURBINE INCLUDING THE SAME, AND STATOR BLADE OF AXIAL FLOW COMPRESSOR

BACKGROUND OF THE INVENTION

Field of the Invention

The present invention relates to an axial flow compressor, a gas turbine including the same, and a stator blade of an axial flow compressor.

Background Art

In axial flow compressors, a rotor blade row and a stator blade row are formed of multiple rotor blades and multiple stator blades which are arranged in a circumferential direction of an annular channel through which a working fluid flows, and one stage consists of one set of a rotor blade row and a stator blade row. The axial flow compressors include multiple stages.

In recent years, the axial flow compressors have needed higher loading which compatibly satisfies a higher pressure ratio and cost saving achieved by reducing the number of stages. In a subsonic airfoil of a high loaded compressor, secondary flow increases due to a developed boundary layer on a wall surface (endwall on one end side of a blade row) on an inner peripheral side or an outer peripheral side of an annular channel where the blade is located. Consequently, pressure loss may increase due to flow stall (corner stall) in a corner portion formed between a blade surface and the wall surface of the channel. Therefore, in order to develop a high performance and high loaded compressor, it is an important task to create a high performance airfoil and channel wall surface contour capable of restraining the corner stall.

For example, as a stator blade of a compressor which can improve both efficiency and a stall margin of the compressor at the same time while flow separation is avoided in the vicinity of a channel wall surface (endwall on one end side of a blade row), JP-A-2001-132696 discloses a technology in which a chord length of a radial span central portion (waist) of a stator blade is set to be shorter than that of a blade tip or a blade hub, and in which a trailing edge of the blade is bowed.

SUMMARY OF THE INVENTION

Incidentally, in a case where an outlet flow angle in an upstream blade row is non-uniform in a blade height direction (radial direction) (for example, in a case where an outlet flow angle in the vicinity of the channel wall surface is larger than an outlet flow angle in a blade height central portion) or in a case where a leakage flow from a downstream side of a blade row flows into an annular channel on the upstream side of the blade row, a boundary layer in the vicinity of the endwall on one end side of the blade row is influenced. JP-A-2001-132696 described above does not mention the influences of this non-uniformity of the outlet flow angle of the upstream blade row or the flow leakage. It is understood that JP-A-2001-132696 does not sufficiently consider these influences. That is, in the compressor including the stator blade disclosed in JP-A-2001-132696, if a flow direction of the boundary layer in the vicinity of the endwall on one end side of the stator blade row is greatly distorted (deviated) from a flow direction of a main stream due to the influences of the non-uniform outlet flow angle at the upstream blade row or the leakage flow, there is a possibility that the corner stall cannot be avoided.

In addition, even in a case where the boundary layer on the channel wall surface at an inlet of the blade row is thick due to a certain factor, similarly to the above-described case where the outlet flow angle at the upstream blade row is non-uniform or the above-described case where the leakage flow occurs, there is a possibility that the flow of the boundary layer on the endwall on one end side of the blade row is greatly distorted from the main stream. Accordingly, there is a possibility that the corner stall cannot be avoided.

This flow separation or stall causes an unsteady flow induced vibration such as buffeting, surging, and the like. Consequently, there is a possibility of poor reliability of the compressor. Furthermore, the influence of the flow separation is not limited to the blade on which the flow separation occurs. That is, the flow separation causes an inlet flow angle with respect to the downstream blade to be non-uniform in the blade height direction. Consequently, there is also a possibility that pressure loss may increase in a subsequent blade row or that reliability of the compressor may become poor. In this case, the possibility results in serious inefficiency or poor reliability of the overall compressor.

In addition, even if the corner stall can be avoided, when the outlet flow angle at an outlet of the blade row is brought into a non-uniform state, the inlet flow angle with respect to the downstream blade row inevitably becomes non-uniform. In this case, there is also the possibility that pressure loss may increase in the subsequent blade row or that reliability of the compressor may become poor.

The present invention is made in order to solve the above-described problems, and an object thereof is to provide an axial flow compressor, a gas turbine including the same, and a stator blade of an axial flow compressor, which can achieve improved efficiency and ensured reliability of an overall compressor by restraining corner stall of a blade and optimizing an inflow condition for a subsequent blade row at the same time.

In order to solve the above-described problems, for example, the present invention adopts configurations disclosed in the scope of Claims.

Although the present application includes multiple means for solving the above-described problems, an example will be described as follows. There is provided an axial flow compressor including multiple rotor blade rows configured to include multiple rotor blades and multiple stator blade rows configured to include multiple stator blades, the multiple rotor blades and the multiple stator blades being arranged in an annular channel through which a working fluid flows. A portion of at least one wall surface on an inner peripheral side and an outer peripheral side of the annular channel, the portion being at an arrangement portion where at least any one blade row of the rotor blade rows and the stator blade rows is located, has a protruding portion such that downstream side part of the portion is curved so as to further protrude to the annular channel than upstream side part of the portion. Each blade of the blade row located at the protruding portion of the wall surface is configured such that an increase rate in a wall surface direction of a blade outlet angle in a blade end portion on the side of the wall surface having the protruding portion is greater than an increase rate in the wall surface direction of a blade outlet angle in a blade height intermediate portion.

According to the present invention, the downstream side of the portion of the wall surface of the annular channel where at least any one blade row of the rotor blade rows and the stator blade rows is located further protrudes to the annular channel than the upstream side of the portion. Accordingly, development of a boundary layer on the wall surface of the channel is locally restrained. Therefore, it is possible to restrain flow separation (corner stall) in a corner portion formed between a blade surface and the wall surface of the channel. Furthermore, the increase rate in the wall surface direction of the blade outlet angle in the blade end portion on the side of the wall surface having the protruding portion is set to be greater than the increase rate of the blade outlet angle in the blade height intermediate portion. Accordingly, it is possible to restrain an outlet flow angle of flow at an outlet of the blade row from being excessively decreased due to the protruding portion of the channel wall surface. Therefore, it is possible to optimize an inflow condition for a subsequent blade row. As a result, it is possible to realize improved efficiency and ensured reliability of the overall compressor.

An object, configuration, and advantageous effect in addition to those described above will be apparent from the description of the following embodiments.

DETAILED DESCRIPTION OF THE INVENTION

Hereinafter, an axial flow compressor, a gas turbine including the same, and a stator blade of an axial flow compressor according to embodiments of the present invention will be described with reference to the drawings. Herein, an example will be described in which the present invention is applied to the axial flow compressor of the gas turbine. However, for example, the present invention is also applicable to an axial flow compressor for industries.

[First Embodiment]

Figure 1:
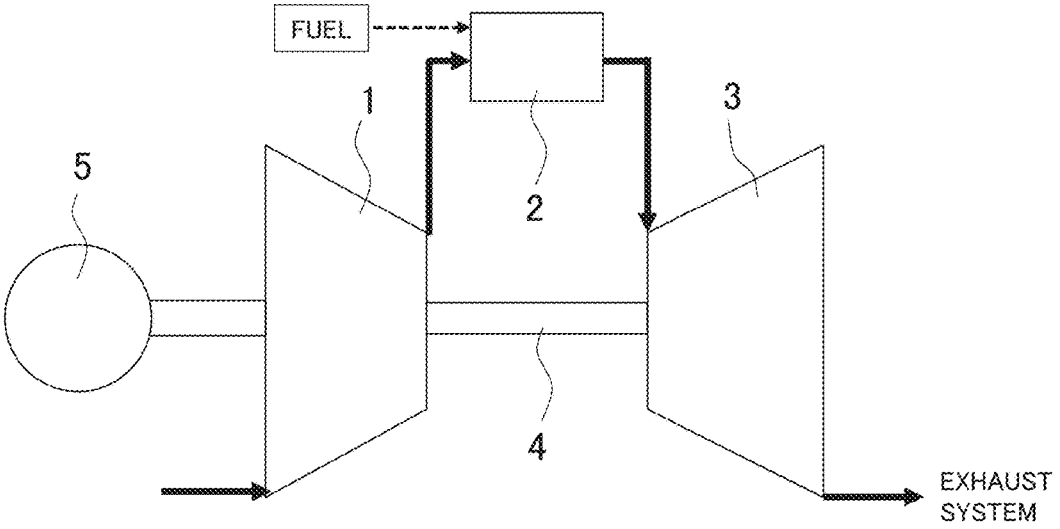
FIG. 1 is a configuration diagram illustrating a gas turbine including an axial flow compressor according to a first embodiment of the present invention.
Figure 2:
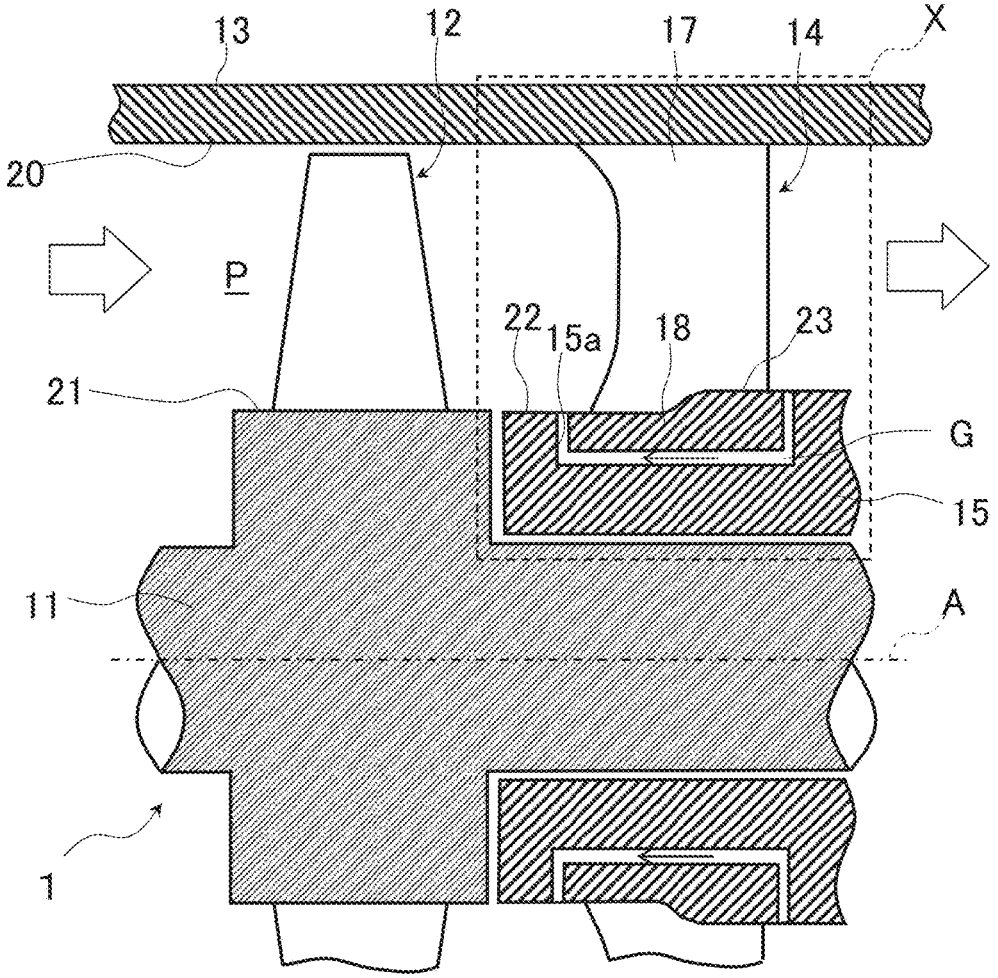
FIG. 2 is a meridional sectional view illustrating a main portion structure of the axial flow compressor according to the first embodiment of the present invention.

First, a configuration of an axial flow compressor, a gas turbine including the same, and a stator blade of an axial flow compressor according to a first embodiment of the present invention will be described with reference to FIGS. 1 and 2. FIG. 1 is a configuration diagram illustrating the gas turbine including the axial flow compressor according to the first embodiment of the present invention. FIG. 2 is a meridional sectional view illustrating a main portion structure of the axial flow compressor according to the first embodiment of the present invention. In FIG. 1, a solid line arrow illustrates a flow of a working fluid, and a broken line arrow illustrates a flow of a fuel. In FIG. 2, a white arrow illustrates the flow of the working fluid, and a solid arrow illustrates a leakage flow.

In FIG. 1, the gas turbine includes an axial flow compressor 1 that compresses suctioned air, a combustor 2 that combusts a fuel together with the air compressed by the axial flow compressor 1 to generate combustion gas, and a turbine 3 that is driven by the combustion gas generated by the combustor 2. The axial flow compressor 1 and the turbine 3 are directly connected to each other by a shaft 4. A power generator 5 for generating power is connected to the gas turbine.

In FIG. 2, the axial flow compressor 1 includes a rotor 11 that is rotatably held, a rotor blade row 12 configured to include multiple rotor blades attached in a circumferential direction in an outer peripheral portion of the rotor 11, a casing 13 enclosing the rotor 11, and a stator blade row 14 configured to include multiple stator blades attached in the circumferential direction in an inner peripheral portion of the casing 13. A combination of the rotor blade row 12 and the stator blade row 14 configures one stage. The axial flow compressor 1 includes multiple stages in an axial direction of the rotor 11 (FIG. 2 illustrates only the final stage rotor blade row and stator blade row). The axial flow compressor 1 has limitations on a pressure ratio which can be achieved by a single stage. Accordingly, the pressure ratio adequate for the purpose is achieved by arranging multiple stages in series. A portion downstream from the rotor blade row 12 of the final stage in the rotor 11 is covered with an inner peripheral casing 15 with a gap. An annular groove portion 15*a* is disposed in an outer peripheral portion on an upstream side of the inner peripheral casing 15.

For example, each of the stator blades of the stator blade row 14 is configured to include a blade section 17 which is supported by the casing 13 in a cantilever manner and has an airfoil-shaped cross-section, and a blade tip shroud 18 disposed in an inner peripheral end of the blade section 17. The blade tip shrouds 18 of the stator blades adjacent in the circumferential direction are connected to each other, and the connected blade tip shrouds in the overall stator blade row 14 are formed in an annular shape. The connected blade tip shrouds 18 having the annular shape are arranged in the groove portion 15*a* of the inner peripheral casing 15. In order to allow relative deviation between the casing 13 and the inner peripheral casing 15 when the axial flow compressor 1 is actuated, a gap G is disposed between the blade tip shroud 18 and a bottom surface or a side surface partitioning the groove portion 15*a* of the inner peripheral casing 15.

The rotor blade rows 12 and the stator blade rows 14 are arranged inside an annular channel P through which the working fluid flows. A wall surface on an outer peripheral side of the annular channel P is mainly configured to include an inner peripheral surface 20 of the casing 13. Apart of a wall surface on an inner peripheral side of the annular channel P is configured to include an outer peripheral surface 21 of an arrangement portion of the rotor blade row 12 in the rotor 11, an outer peripheral surface 22 of the inner peripheral casing 15, and outer peripheral surfaces 23 of the blade tip shrouds 18. That is, wall surfaces (endwalls) located on the inner peripheral end side and the outer peripheral end side of the rotor blade rows 12 and the stator blade rows 14 are part of the wall surfaces on the inner peripheral side and the outer peripheral side of the annular channel P. The annular channel P on the downstream side from the stator blade row 14 and the annular channel P on the upstream side from the stator blade row 14 communicate with each other through the gap G.

Next, a detailed structure of the stator blade row and the wall surface on one end side of the stator blade row configuring a part of the axial flow compressor and the gas turbine including the same according to the first embodiment of the present invention and will be described with reference to FIGS. 3 to 6.

Figure 3:
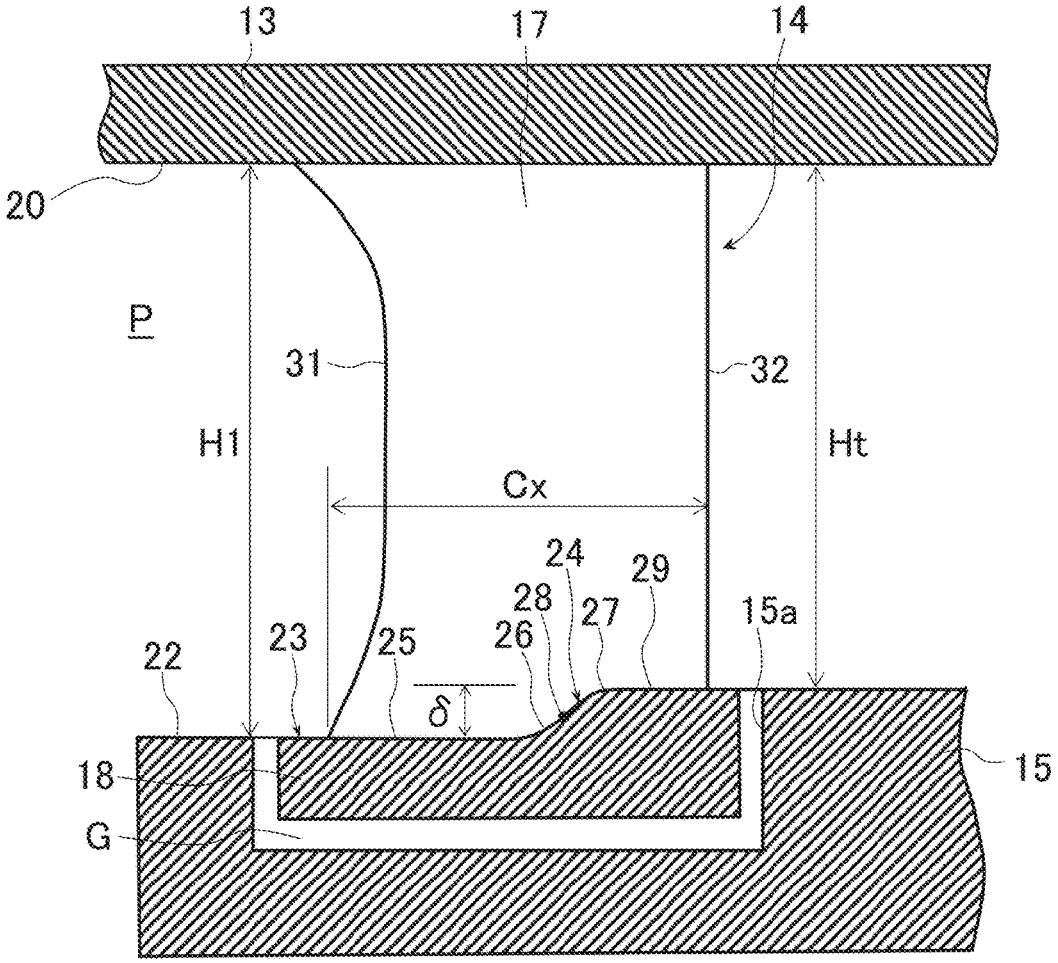
FIG. 3 is an enlarged meridional sectional view illustrating a stator blade of a stator blade row and a wall surface of an annular channel which are indicated by the reference numeral X in FIG. 2.
Figure 4:
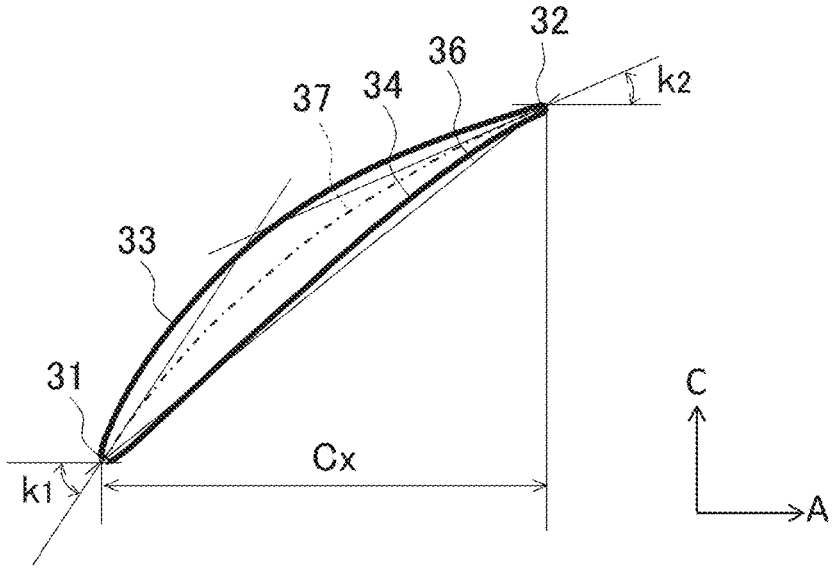
FIG. 4 is a view for describing various shape parameters of an airfoil of blades configuring a blade row.
Figure 5:
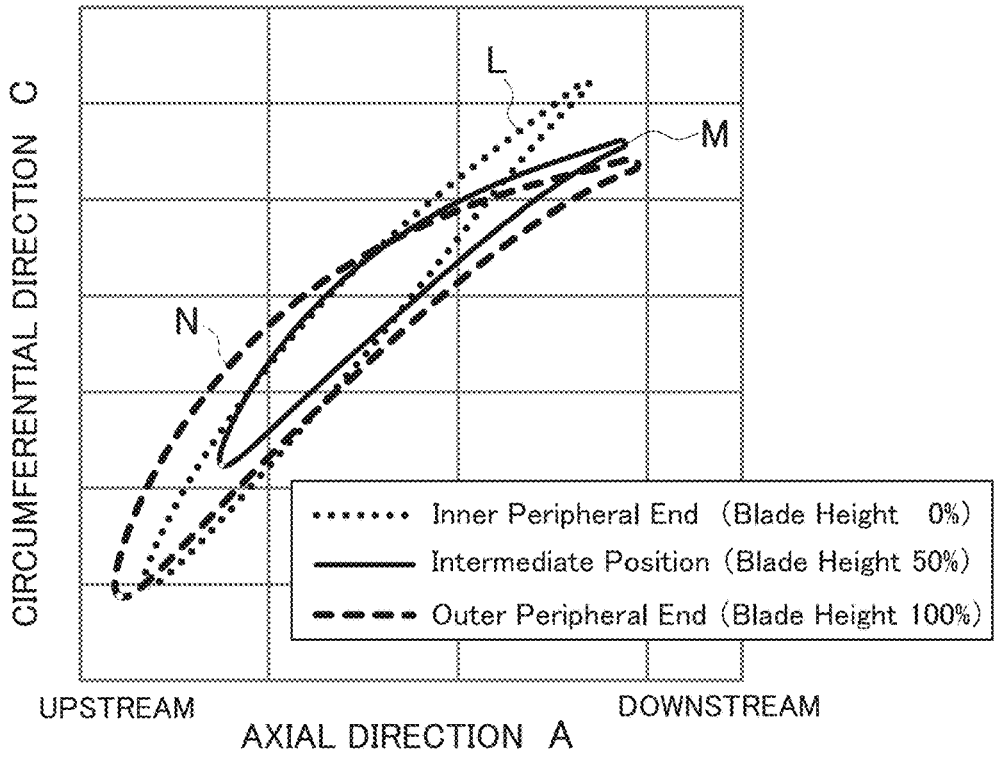
FIG. 5 is a view for describing airfoils of an inner peripheral end, an intermediate portion, and an outer peripheral end of the stator blade configuring a part of the axial flow compressor according to the first embodiment of the present invention which is illustrated in FIG. 3.
Figure 6:
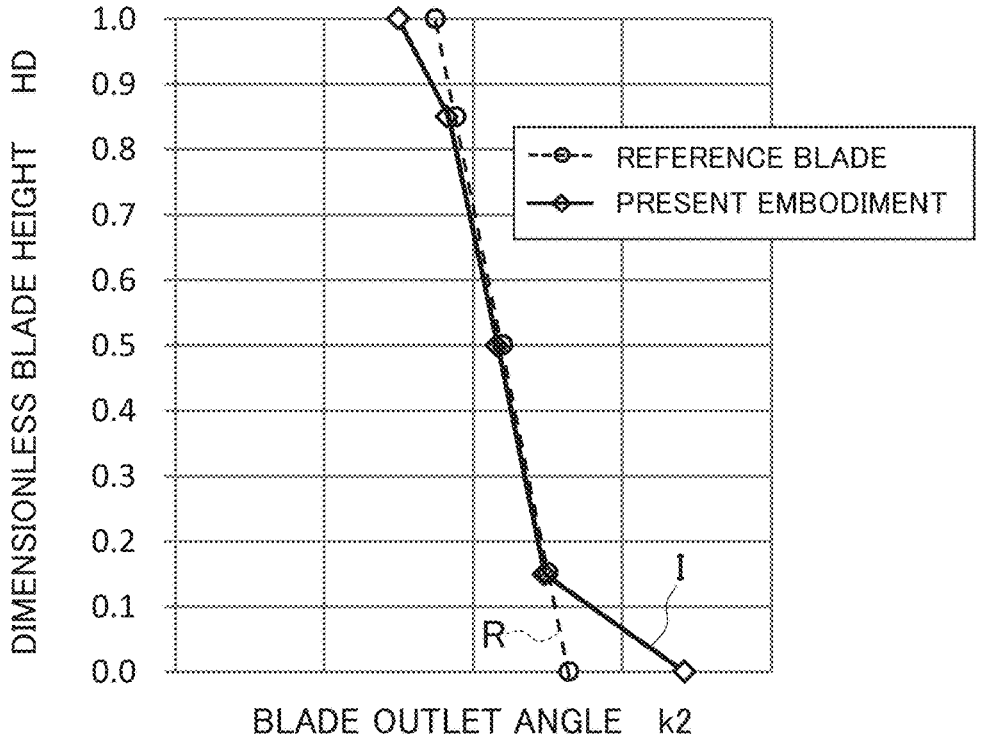
FIG. 6 is a characteristic view illustrating a blade outlet angle distribution in a blade height direction in the stator blade configuring a part of the axial flow compressor according to the first embodiment of the present invention which is illustrated in FIG. 3 and a blade outlet angle distribution in a reference blade as a comparative example.

FIG. 3 is an enlarged meridional sectional view illustrating the stator blade of the stator blade row and a wall surface of the annular channel which are indicated by the reference numeral X in FIG. 2. FIG. 4 is a view for describing various shape parameters of an airfoil of the blades configuring the blade row. FIG. 5 is a view for describing airfoils of an inner peripheral end, an intermediate portion, and an outer peripheral end of the stator blade configuring a part of the axial flow compressor according to the first embodiment of the present invention which is illustrated in FIG. 3. FIG. 6 is a characteristic view illustrating a blade outlet angle distribution in a blade height direction of the stator blade configuring a part of the axial flow compressor according to the first embodiment of the present invention which is illustrated in FIG. 3 and a blade outlet angle distribution in a reference blade as a comparative example. In FIG. 4, an arrow A indicates the axial direction of the rotor, and an arrow C indicates the circumferential direction of the rotor. In FIG. 5, a vertical axis C indicates the circumferential direction of the rotor, and a horizontal axis A indicates the axial direction of the rotor. A dotted line L indicates an airfoil of the inner peripheral end (blade height 0%) of the blade section of the stator blade. A solid line M indicates an airfoil of the intermediate position (blade height 50%) between the inner peripheral end and the outer peripheral end of the blade section. A broken line N indicates an airfoil of the outer peripheral end (blade height 100%) of the blade section. In FIG. 6, a vertical axis HD indicates a dimensionless blade height, and a horizontal axis k2 indicates a blade outlet angle. The dimensionless blade height HD is a ratio of any blade height from the inner peripheral end of the blade section with respect to an entire length of the blade section, and represents a relative position of any blade height with respect to the entire length of the blade section. In addition, a solid line I indicates a case according to the present embodiment, and a broken line R indicates a case of a reference blade (to be described later). In FIGS. 3 to 6, the reference numerals which are the same as the reference numerals illustrated in FIGS. 1 and 2 indicate the same elements, and thus, detailed description thereof will be omitted.

As illustrated in FIGS. 3 and 4, the blade section 17 of the stator blade of the stator blade row 14 is configured to include a leading edge 31 as an upstream side edge, a trailing edge 32 as a downstream side edge, a suction surface 33 which extends on a blade ventral side between the leading edge 31 and the trailing edge 32, and a pressure surface 34 which extends on a blade rear side between the leading edge 31 and the trailing edge 32. A straight line which connects the leading edge 31 and the trailing edge 32 is a chord line 36, and the length in the axial direction of the chord line 36 is an axial chord length Cx. A curve obtained by sequentially connecting a midpoint between the suction surface 33 and the pressure surface 34 of the blade shape is a camber line 37. An angle formed between a tangent line and an axial direction A at the leading edge 31 of the camber line 37 is a blade inlet angle k1. An angle formed between the tangent line and the axial direction A at the trailing edge 32 of the camber line 37 is a blade outlet angle k2. In a case of the rotor blade of the rotor blade row 12, an airfoil of the rotor blade is also configured to include a leading edge 31*r*, a trailing edge 32*r*, a suction surface, and a pressure surface. Each definition of the axial chord length Cx, the blade inlet angle k1, and the blade outlet angle k2 is also the same as each definition in the case of the stator blade (refer to FIGS. 16 and 17 to be described later).

As illustrated in FIG. 3, a meridional shape of the leading edge 31 of the blade section 17 of the stator blade is formed such that the inner peripheral side end portion and the outer peripheral side end portion extend to the upstream side from the blade height intermediate portion. On the other hand, the meridional shape of the trailing edge 32 of the blade section 17 is substantially linear in the blade height direction (radial direction). That is, as illustrated in FIGS. 3 and 5, the axial chord length Cx of the blade section 17 is set so that the inner peripheral side end portion and the outer peripheral side end portion are longer than the blade height intermediate portion. The inner peripheral side end portion and the outer peripheral side end portion of the blade section 17 are formed so that the axial chord length Cx gradually decreases toward the blade height intermediate portion. In the description herein, the inner peripheral side end portion of the blade section 17 (blade end portion on the inner peripheral side) is a region which is likely to receive the influence of a boundary layer generated on the wall surface on the inner peripheral side of the annular channel P, and is specifically a portion from the inner peripheral end to a height of approximately 15% of the entire length of the blade section 17. Similarly, the outer peripheral side end portion of the blade section 17 (blade end portion on the outer peripheral side) is a region which is likely to receive the influence of a boundary layer generated on the wall surface on the outer peripheral side of the annular channel P, and is specifically a portion from a height of approximately 85% of the entire length of the blade section 17 to the outer peripheral end. The blade height intermediate portion of the blade section 17 is a region which is less likely to receive the influence of the boundary layers generated on the inner peripheral side wall surface and the outer peripheral side wall surface of the annular channel P and which receives the influence of a main stream, and is a portion excluding the inner peripheral side end portion and the outer peripheral side end portion from the blade section 17, that is, a portion from approximately 15% to approximately 85% of the entire length of the blade section 17.

In addition, as illustrated in FIGS. 5 and 6, the inner peripheral side end portion of the blade section 17 is set such that the blade outlet angle is larger than the blade outlet angle of the blade height intermediate portion. Furthermore, as illustrated in FIG. 6, a distribution in the blade height direction of the blade outlet angle k2 in the inner peripheral side end portion of the blade section 17 gradually increases in the inner peripheral end direction (inner peripheral side wall surface direction of the annular channel P). In addition, a distribution in the blade height direction of the blade outlet angle k2 in the blade height intermediate portion of the blade section 17 monotonously increases in the inner peripheral end direction, for example. In addition, an increase rate in the inner peripheral end direction (inner peripheral side wall surface direction of the annular channel P) of the blade outlet angle k2 in the inner peripheral side end portion of the blade section 17 is set to be greater than an increases rate in the inner peripheral end direction of the blade outlet angle k2 in the blade height intermediate portion.

Referring back to FIG. 3, an arrangement portion of the stator blade row 14 on the inner peripheral surface 20 of the casing 13, that is, the wall surface on the outer peripheral side of the stator blade row 14 in the annular channel P is formed into a cylindrical surface whose radius from a rotation axis A (refer to FIG. 2) of the rotor 11 is substantially constant. The outer peripheral surface 22 on the upstream side from the groove portion 15*a* in the inner peripheral casing 15, that is, a portion on the upstream side from the stator blade row 14 on the inner peripheral side wall surface of the annular channel P is formed into a cylindrical surface such that a meridional channel height H1 of the annular channel P in an inlet (leading edge 31) of the stator blade row 14 is substantially constant.

The outer peripheral surface 23 of the blade tip shroud 18 of the stator blade row 14, that is, the wall surface on the inner peripheral side of the stator blade row 14 in the annular channel P has a protruding portion 24 such that downstream side part of the outer peripheral surface 23 is curved so as to further protrude to the annular channel P as much as δ than upstream side part of the outer peripheral surface 23. The protruding portion 24 is uniformly formed in the circumferential direction. In other words, a meridional channel height Ht of the annular channel P at an outlet (trailing edge 32) of the stator blade row 14 is set so as to further decrease as much as δ than the meridional channel height H1 at the inlet of the stator blade row 14. A specific configuration of the outer peripheral surface 23 of the blade tip shroud 18 includes a first cylindrical surface 25 which is located on substantially the same plane as the outer peripheral surface 22 on the upstream side from the groove portion 15*a* of the inner peripheral casing 15, a first curved surface 26 which is smoothly connected to the first cylindrical surface 25 while being located on the downstream side of the first cylindrical surface 25 and which has a shape convex to the outside of the annular channel P, a second curved surface 27 which is smoothly connected to the first curved surface 26 while being located on the downstream side of the first curved surface 26 and which has a shape convex to the inside of the annular channel P, an inflection point 28 between the first curved surface 26 and the second curved surface 27, and a second cylindrical surface 29 which is smoothly connected to the second curved surface 27 while being located on the downstream side of the second curved surface 27. The second cylindrical surface 29 is located on the outer side in the radial direction as much as δ from the first cylindrical surface 25. For example, a ratio of the position of the inflection point 28 in the axial direction from the leading edge 31 is approximately 50% with respect to the axial chord length Cx.

Next, a flow of the working fluid in the axial flow compressor and the gas turbine including the same according to the first embodiment of the present invention will be schematically described with reference to FIGS. 1 and 2.

Air serving as the working fluid is suctioned and compressed by the axial flow compressor 1 of the gas turbine illustrated in FIG. 1. The compressed air is guided to the combustor 2, is mixed with the fuel, and is combusted, thereby generating hot combustion gas. The combustion gas drives the turbine 3, and thermal energy is converted into power energy. The power energy is consumed by driving the axial flow compressor 1, and is converted into electric energy by the power generator 5.

The working fluid suctioned into the axial flow compressor 1 illustrated in FIG. 2 passes the rotor blade row 12 arranged inside the meridional channel P (annular channel of the meridional cross section), and thereafter, flows out to the downstream through the stator blade row 14 as a discharged air flow. At this time, the working fluid is provided with kinetic energy by the rotor blade row 12 rotating with the rotor 11 driven by the turbine 3 (refer to FIG. 1). Furthermore, the working fluid is decelerated and the flow direction is changed in the stator blade row 14. In this manner, the kinetic energy is converted into pressure energy, thereby bringing the working fluid into a state of high pressure and high temperature. The working fluid passing through the meridional channel P alternately passes through the multiple rotor blade rows 12 and the multiple stator blade rows 14, and thus reaches a predetermined high pressure state.

Next, an operation and an advantageous effect of the axial flow compressor, the gas turbine including the same, and the stator blade of the axial flow compressor according to the first embodiment of the present invention will be described with reference to a comparison with a reference blade in the related art.

First, a configuration and an operation of the reference blade in the related art as a comparative example with respect to the axial flow compressor, the gas turbine including the same, and the stator blade of the axial flow compressor according to the first embodiment of the present invention will be described with reference to FIGS. 6 to 10.

Figure 7:
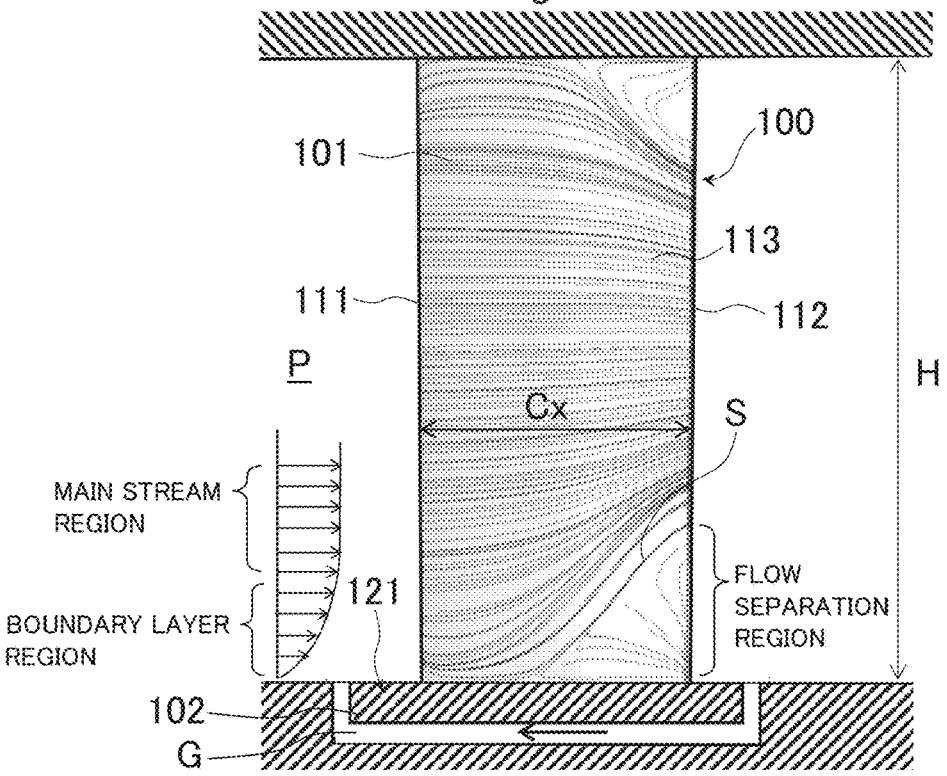
FIG. 7 is a view for describing a meridional flow in the case of the reference blade and a channel wall surface having a conventional shape as a comparative example with respect to the stator blade and the channel wall surface configuring parts of the axial flow compressor according to the first embodiment of the present invention.
Figure 8:
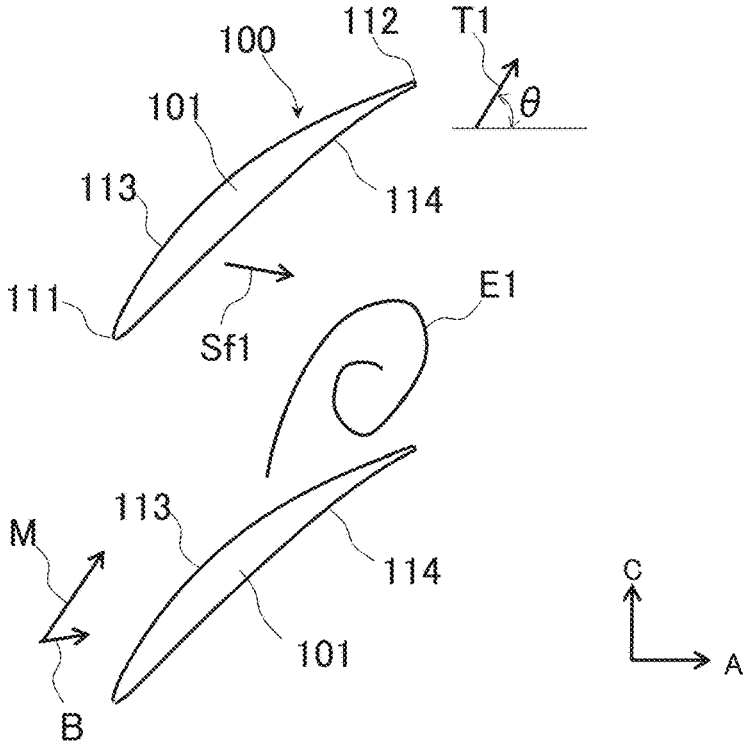
FIG. 8 is a view for describing a flow between the blades in a case of a blade row formed of the reference blades as a comparative example with respect to the stator blade row configuring a part of the axial flow compressor according to the first embodiment of the present invention.
Figure 9:
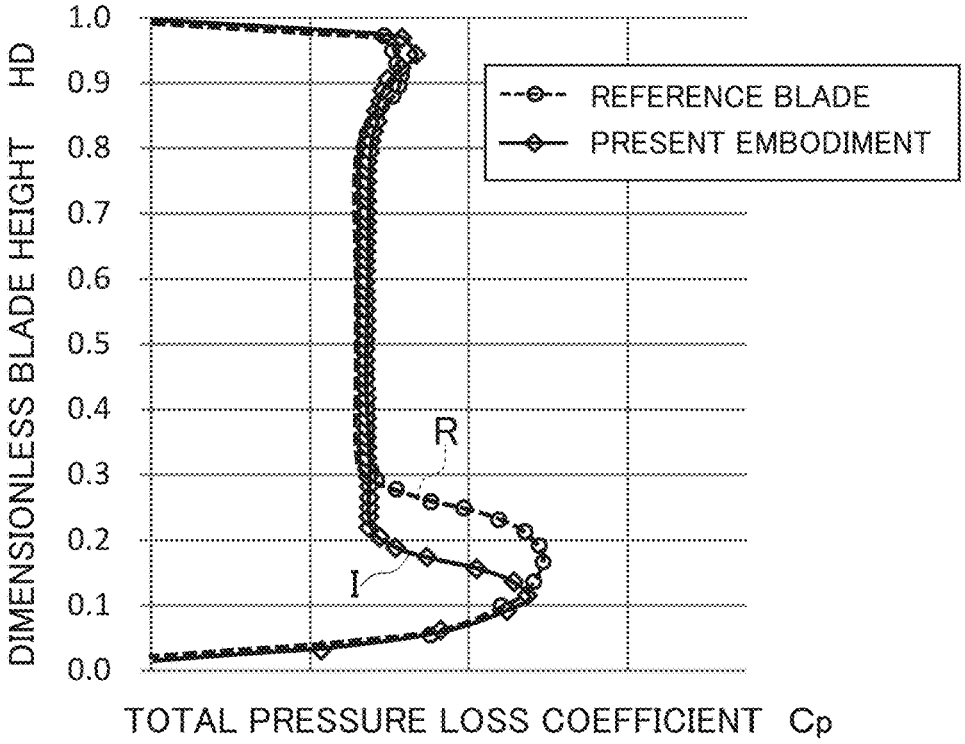
FIG. 9 is a characteristic view illustrating a total pressure loss distribution in the blade height direction in the stator blade configuring a part of the axial flow compressor according to the first embodiment of the present invention which is illustrated in FIG. 3 and a total pressure loss distribution in the reference blade in the related art.
Figure 10:
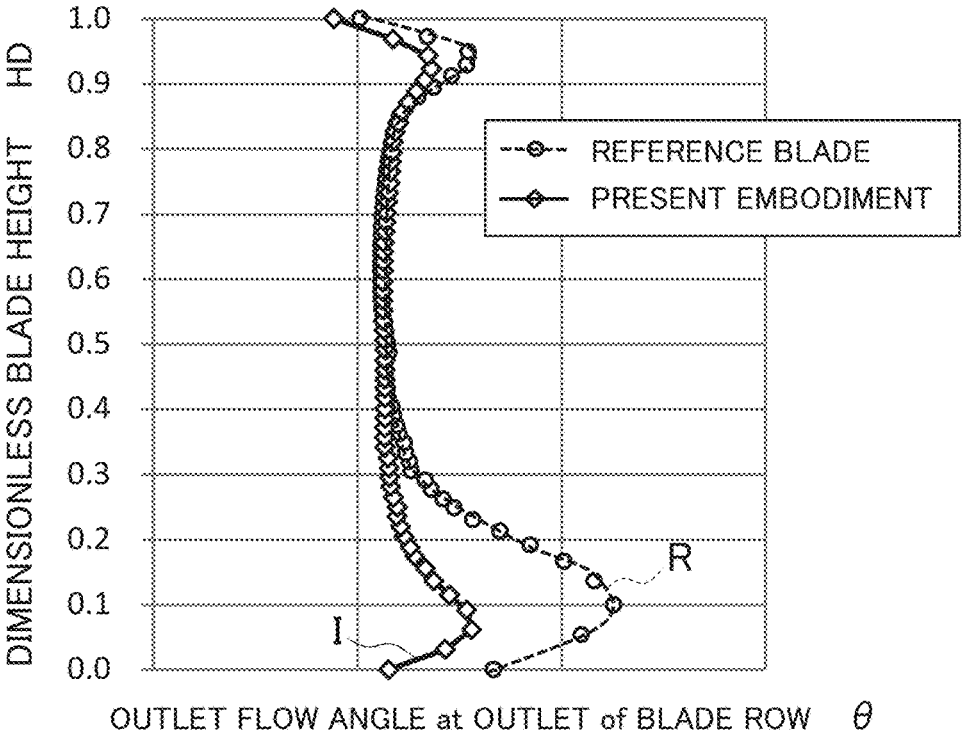
FIG. 10 is a characteristic view illustrating an outlet flow angle distribution in the blade height direction in the stator blade configuring a part of the axial flow compressor according to the first embodiment of the present invention which is illustrated in FIG. 3 and an outlet flow angle distribution in the reference blade in the related art.

FIG. 7 is a view for describing a meridional flow in the case of the reference blade and a channel wall surface having a conventional shape as a comparative example with respect to the stator blade and the channel wall surface configuring parts of the axial flow compressor according to the first embodiment of the present invention. FIG. 8 is a view for describing a flow between the blades in a case of a blade row formed of the reference blades as a comparative example with respect to the stator blade row configuring a part of the axial flow compressor according to the first embodiment of the present invention. FIG. 9 is a characteristic view illustrating a total pressure loss distribution in the blade height direction in the stator blade configuring a part of the axial flow compressor according to the first embodiment of the present invention which is illustrated in FIG. 3 and a total pressure loss distribution in the reference blade in the related art. FIG. 10 is a characteristic view illustrating an outlet flow angle distribution in the blade height direction in the stator blade configuring a part of the axial flow compressor according to the first embodiment of the present invention which is illustrated in FIG. 3 and an outlet flow angle distribution in the reference blade in the related art. In FIG. 8, the arrow A indicates the axial direction of the rotor, and the arrow C indicates the circumferential direction of the rotor. In FIG. 9, the vertical axis HD indicates the dimensionless blade height, and a horizontal axis Cp indicates a total pressure loss coefficient of the blade. In FIG. 10, the vertical axis HD indicates the dimensionless blade height, and a horizontal axis θ indicates the outlet flow angle at the outlet of the blade row. In addition, in FIGS. 9 and 10, the solid line I indicates a case according to the present embodiment, and the broken line R indicates a case of the reference blade. In FIGS. 7 to 10, the reference numerals which are the same as the reference numerals illustrated in FIGS. 1 to 6 indicate the same elements, and thus, detailed description thereof will be omitted.

As illustrated in FIG. 7, a blade section 101 of a reference blade 100 in the related art is formed such that a meridional shape of a leading edge 111 and a trailing edge 112 is substantially linear in the radial direction. That is, the axial chord length Cx of the blade section 101 is substantially constant in the blade height direction (radial direction). In addition, an outer peripheral surface 121 of a blade tip shroud 102 of the reference blade 100 is formed into a cylindrical surface. In other words, a meridional channel height H is set to be substantially constant. As illustrated in FIG. 6, the blade outlet angle k2 of the blade section 101 is distributed so as to monotonously increases from the outer peripheral end (dimensionless blade height 1.0) toward the inner peripheral end (dimensionless blade height 0.0).

When the working fluid flows in the meridional channel P illustrated in FIG. 7, a boundary layer develops on the end walls on the inner peripheral side and the outer peripheral side of the meridional channel P. Moreover, part of the working fluid in the meridional channel P passes through the gap G on the inner peripheral side of the blade tip shroud 102 from the downstream side of the reference blade 100, and becomes a leakage flow which reaches the upstream side of the reference blade 100. The reason is that the downstream side (high pressure side) and the upstream side (low pressure side) of the reference blade 100 having different pressure levels are caused to communicate with each other through the gap G. A flow rate of the leakage flow passing through the gap G is so low as to be approximately 0.5% to 2% of a flow rate of a main stream. The leakage flows is generated due to a pressure difference between the downstream side and the upstream side. Accordingly, unlike the main stream, the leakage flow mainly has an axial velocity component.

When the leakage flow merges with the main stream, the flowing direction of the boundary layer in the vicinity of the inner peripheral endwall of the meridional channel P is changed, and a low speed region of the boundary layer is spread. Accordingly, the boundary layer becomes greatly non-uniform. In a case of the reference blade 100 illustrated in FIG. 7, as is apparent from a distribution of streamlines S on a suction surface 113 of the blade section 101, great non-uniformity of the boundary layer due to the leakage flow consequently causes corner stall in a downstream region on the side of the suction surface 113 of the blade section 101.

That is, as illustrated in FIG. 8, a flow B of the boundary layer in the vicinity of the inner peripheral endwall which receives the influence of the leakage flow has a flowing direction and velocity which are greatly different from those of a main stream M away from the inner peripheral endwall. Due to the influence of a secondary flow Sf1 from the side of a pressure surface 114 toward the side of the suction surface 113 between blade sections 101, the flow B of the boundary layer cannot resist an adverse pressure gradient in the downstream region on the side of the suction surface 113 of the blade section 101. As a result, a great backflow vortex E1 is generated, and a flow separation region is formed, thereby causing considerable pressure loss. That is, as illustrated in FIG. 9, a total pressure loss coefficient Cp increases in the vicinity of the inner peripheral endwall (dimensionless blade height HD is 0.05 to 0.3).

At the same time, as illustrated in FIG. 8, a blockage effect of the flow separation region causes an outlet flow T1 at an outlet of the blade row of the reference blades 100 to be further oriented to a circumferential direction side C. That is, as illustrated in FIG. 10, an outlet flow angle θ at the outlet of the blade row of the reference blades 100 increases in the vicinity of the inner peripheral endwall (dimensionless blade height HD is 0.0 to 0.3). Since the outlet flow T1 is oriented to the circumferential direction side C, the inlet flow angle increases with respect to a subsequent blade row of the blade row, and a mismatch of the inlet flow angle occurs in the subsequent blade row, thereby increasing the loss.

In this way, in the case of the reference blade 100 in the related art, due to the influence of the leakage flow from the downstream side to the upstream side of the reference blade 100 via the gap G, the flow separation region is formed in the downstream region on the side of the suction surface 113 of the blade section 101, thereby increasing the loss. Furthermore, due to the blockage of the formed flow separation region, the outlet flow angle θ of the working fluid at the outlet of the blade row increases in the vicinity of the inner peripheral endwall. Therefore, the inlet flow angle increases with respect to the subsequent blade row of the blade row in which the flow separation occurs, thereby increasing the risk that pressure loss increase or flow separation may occur in the subsequent blade row.

Next, an operation and an advantageous effect of the axial flow compressor, the gas turbine including the same, and the stator blade of the axial flow compressor according to the first embodiment of the present invention will be described with reference to FIGS. 3, 5, 6, and 9 to 12.

Figure 11:
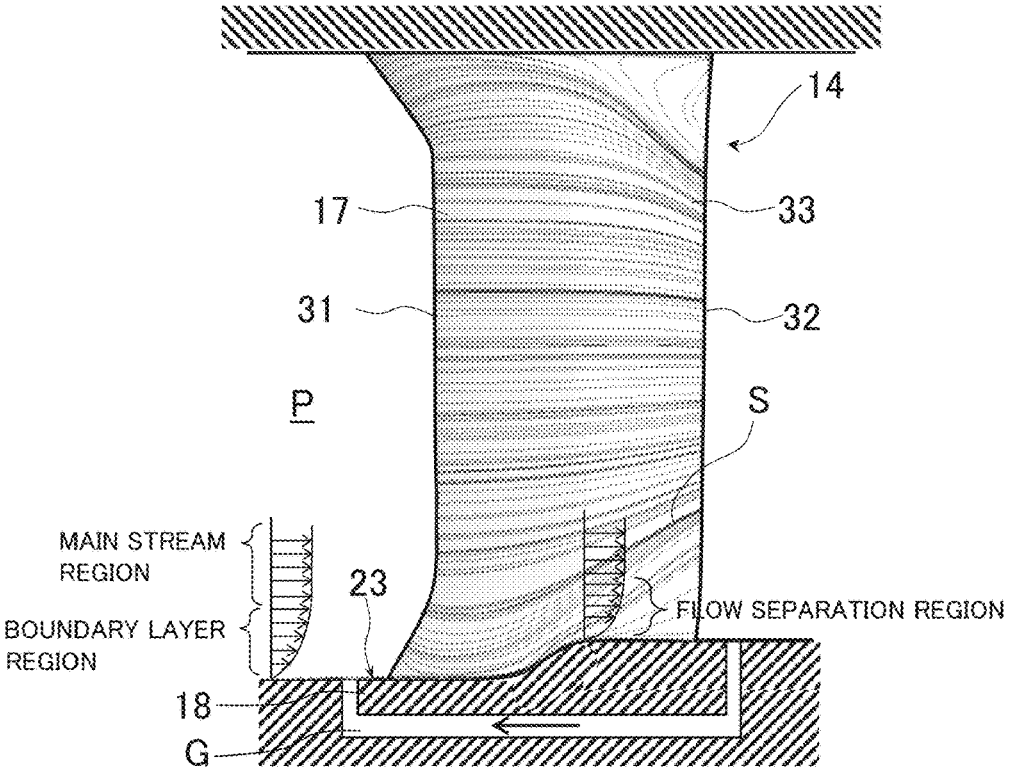
FIG. 11 is a view for describing a meridional flow in a case of the stator blade and the channel wall surface configuring parts of the axial flow compressor according to the first embodiment of the present invention which is illustrated in FIG. 3.
Figure 12:
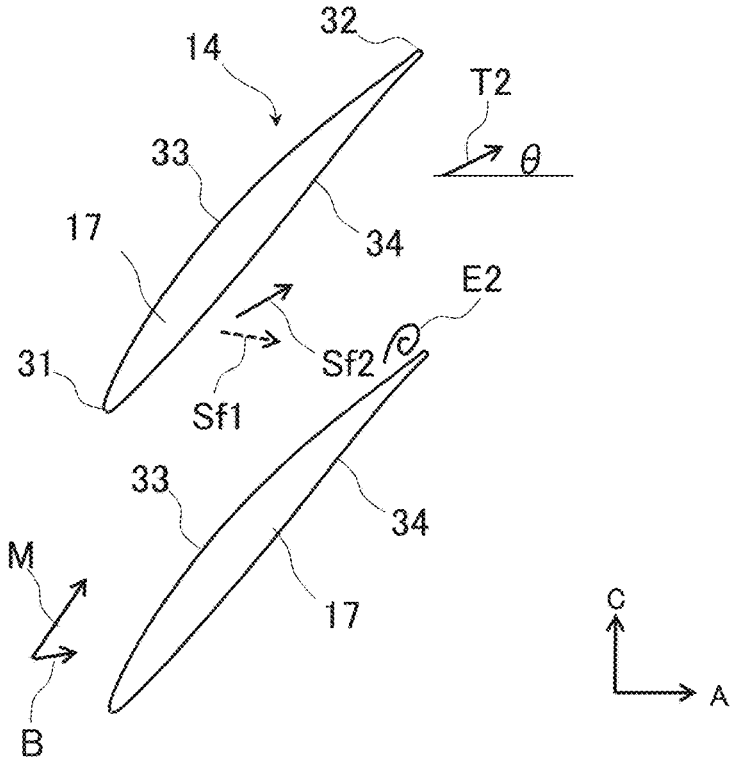
FIG. 12 is a view for describing a flow between the blades in a case of the stator blade row configuring a part of the axial flow compressor according to the first embodiment of the present invention which is illustrated in FIG. 3.

FIG. 11 is a view for describing a meridional flow in a case of the stator blade and the channel wall surface configuring parts of the axial flow compressor according to the first embodiment of the present invention which is illustrated in FIG. 3. FIG. 12 is a view for describing a flow between the blades in a case of the stator blade row configuring a part of the axial flow compressor according to the first embodiment of the present invention which is illustrated in FIG. 3. In FIG. 12, the arrow A indicates the axial direction of the rotor or the casing, and the arrow C indicates the circumferential direction of the rotor or the casing. In FIGS. 11 and 12, the reference numerals which are the same as the reference numerals illustrated in FIGS. 1 to 10 indicate the same elements, and thus, detailed description thereof will be omitted.

In the present embodiment, as illustrated in FIG. 3, the height of the meridional channel is set to be substantially constant in the upstream side portion of the stator blade row 14 in which the flow is accelerated, thereby relieving acceleration of the flow. As a result, the pressure loss caused by friction against the blade surface of the blade section 17 of the stator blade row 14 is restrained. On the other hand, the downstream side part of the outer peripheral surface 23 (wall surface on the inner peripheral side of the stator blade row 14 in the meridional channel P) of the blade tip shroud 18 is set to have a shape protruding to the meridional channel P such that the meridional channel height in the downstream side portion of the stator blade row 14 in which the flow is greatly decelerated is lower than the meridional channel height in the upstream side portion. Accordingly, the deceleration of the flow of the boundary layer is locally relieved on the inner peripheral side wall surface of the meridional channel P. Therefore, the development of the boundary layer which is greatly non-uniform due to the leakage flow is restrained on the inner peripheral side wall surface. As a result, corner stall can be restrained. That is, as illustrated in FIG. 11, as is apparent from a distribution of the streamlines S on the suction surface 33 of the stator blade row 14 according to the present embodiment, compared to the case of the reference blade 100 (refer to FIG. 7), since there is provided the protruding shape of the downstream side part of the outer peripheral surface 23 (wall surface on the inner peripheral side of the stator blade row 14 in the meridional channel P) of the blade tip shroud 18, the low speed portion of the boundary layer on the inner peripheral side wall surface which is developed by the leakage flow comes to have a locally thinned layer.

In addition, the deceleration of the flow in the downstream side portion of the stator blade row 14 is further relieved by protruding the downstream side part of the inner peripheral endwall of the stator blade row 14, compared to the case of the reference blade 100. Accordingly, as illustrated in FIG. 12, a secondary flow Sf2 generated between the blade sections 17 of the stator blade row 14 is further oriented to the axial direction A, compared to the secondary flow Sf1 in the case of the reference blade 100. Therefore, the decelerated flow decreases, which is caught in a backflow vortex E2 generated in the vicinity of the trailing edge 32 on the suction surface side 33 of the blade section 17, thereby restraining the development of the backflow vortex E2.

The restrained development of the backflow vortex E2 decreases a blockage effect, and the protruding inner peripheral side wall surface of the meridional channel P further increase the flow velocity in the axial direction, compared to the case of the reference blade 100. In this manner, an outlet flow T2 at the outlet of the stator blade row 14 is further oriented to the axial direction A, compared to the case of the reference blade 100. In the present embodiment, as illustrated in FIGS. 5 and 6, an increase rate in the inner peripheral end direction (inner peripheral side wall surface direction of the annular channel P) of the blade outlet angle in the inner peripheral side end portion of the blade section 17 is set to be greater than that in the blade height intermediate portion of the blade section 17. Accordingly, as an airfoil of the stator blade row 14, there is an advantageous effect in that the flow of the boundary layer on the inner peripheral endwall of the stator blade row 14 is further oriented to the circumferential direction C. That is, it is possible to prevent the outlet flow T2 at the outlet of the stator blade row 14 from being excessively changed to the axial direction A due to the protruding inner peripheral side wall surface of the meridional channel P. As a result, it is possible to optimize or uniformize an inflow condition for the subsequent blade row (including a diffuser downstream of the final stage). In addition, increasing the blade outlet angle in the vicinity of the inner peripheral endwall of the stator blade row 14 corresponds to decreasing flow turning in the vicinity of the inner peripheral endwall. Accordingly, the flow separation is also concurrently restrained in the vicinity of the inner peripheral endwall.

In addition, in the present embodiment, as illustrated in FIG. 3, a portion of the outer peripheral surface 23 of the blade tip shroud 18 from the leading edge 31 to the trailing edge 32 of the blade section 17 is configured to include at least the first curved surface 26, the second curved surface 27 which is smoothly connected to the first curved surface 26, and the inflection point 28 between the first curved surface 26 and the second curved surface 27. In this manner, the protruding shape of the outer peripheral surface 23 is smoothly curved so as not to generate a corner portion. Therefore, the flow separation is prevented from occurring due to the protruding shape itself.

Furthermore, in the present embodiment, a ratio of the position of the inflection point 28 in the axial direction from the leading edge 31 is approximately 50% with respect to the axial chord length Cx. The reason is considered that the flow separation region in the reference blade 100 (refer to FIG. 7) develops from the vicinity of the intermediate portion of the axial chord length Cx of the blade section 17 which is a deceleration starting point of the flow. A parameter survey on flow analysis reveals that the flow separation is effectively avoided by narrowing the meridional channel height in the downstream side portion of the blade section 17 in which the flow is greatly decelerated and the flow separation region is likely to grow so as to accelerate the flow in the vicinity of the inner peripheral side wall surface of the annular channel P. In view of this fact, in order to effectively avoid corner stall, it is preferable that the position of the inflection point 28 in the axial direction from the leading edge 31 is at a ratio from 40% to 60% with respect to the axial chord length Cx.

Furthermore, in the present embodiment, as illustrated in FIGS. 3 and 5, the axial chord length Cx of the inner peripheral side end portion and the outer peripheral side end portion of the blade section 17 is set to be longer than that of the blade height intermediate portion. Lengthening the axial chord length Cx decreases a ratio of the flow turning per unit length and relieves an adverse pressure gradient in the downstream side portion of the blade section, in a case where the flow turning by the blade row is maintained equal. Accordingly, this setting contributes to the restraint of flow separation.

In this way, in the present embodiment, the downstream portion of the wall surface on the inner peripheral side of the stator blade row 14 protrudes in the annular channel P, the axial chord length Cx extends in the inner peripheral side end portion and the outer peripheral side end portion of the blade section 17, and the blade outlet angle in the vicinity of the inner peripheral endwall is increased than the blade outlet angle in the blade height intermediate portion. In this manner, the flow separation (corner stall) is restrained in the downstream side region of the suction surface 33 of the blade section 17. Therefore, as illustrated in FIG. 9, total pressure loss coefficient Cp in the vicinity of the inner peripheral endwall (dimensionless blade height HD is 0.1 to 0.2) of the stator blade row 14 is further decreased, compared to the case of the reference blade 100 in the related art. In addition, it is possible to avoid an unsteady flow induced vibration such as buffeting caused by the corner stall or the flow separation, thereby improving the reliability of the stator blade row 14.

Furthermore, in the present embodiment, as illustrated in FIG. 10, the outlet flow angle θ at the outlet of the blade row in the vicinity of the inner peripheral endwall (dimensionless blade height HD is 0.0 to 0.2), which is oriented to the circumferential direction in the case of the reference blade 100 in the related art, is further oriented to the axial direction. Therefore, it is possible to optimize the inlet flow angle for the subsequent blade row of the stator blade row 14. That is, compared to the case of the reference blade 100 in the related art, the outlet flow angle θ at the outlet of the blade row can be closer to a design value. It is possible to avoid an increase in loss caused by the mismatching of the inlet flow angle at the subsequent blade row. Therefore, it is possible to decrease the loss of not only the blade row to which a structure according to the present embodiment is applied, but also the subsequent blade row.

As described above, according to the axial flow compressor, the gas turbine including the same, and the stator blade of the axial flow compressor according to the first embodiment of the present invention, the downstream side part of the outer peripheral surface 23 (wall surface on the inner peripheral side of the stator blade row 14 in the annular channel P) of the blade tip shroud 18 of the stator blade row 14 further protrudes to the annular channel P than the upstream side portion of the outer peripheral surface 23. In this manner, the development of the boundary layer is locally restrained on the outer peripheral surface 23 of the blade tip shroud 18. Accordingly, it is possible to restrain the corner stall. Furthermore, the increase rate in the inner peripheral end direction of the blade outlet angle in the inner peripheral side end portion of the blade section 17 of the stator blade is set to be greater than that in the blade height intermediate portion of the blade section 17. In this manner, the outlet flow angle at the outlet of the stator blade row 14 is restrained from being excessively decreased due to the protruding outer peripheral surface 23. Accordingly, it is possible to optimize the inlet condition for the subsequent blade row. As a result, it is possible to realize improved efficiency of the overall compressor and ensured reliability of the compressor 1.

In addition, according to the present embodiment, the protruding portion 24 of the inner peripheral side wall surface (outer peripheral surface 23 of the blade tip shroud 18) of the annular channel P is uniformly formed in the circumferential direction of the annular channel P. Accordingly, a member (blade tip shroud 18) configuring the wall surface of the annular channel P is easily manufactured.

[Modification of First Embodiment]

Next, an axial flow compressor and a gas turbine including the same according to a modification of the first embodiment of the present invention will be described with reference to FIGS. 13 and 14.

Figure 13:
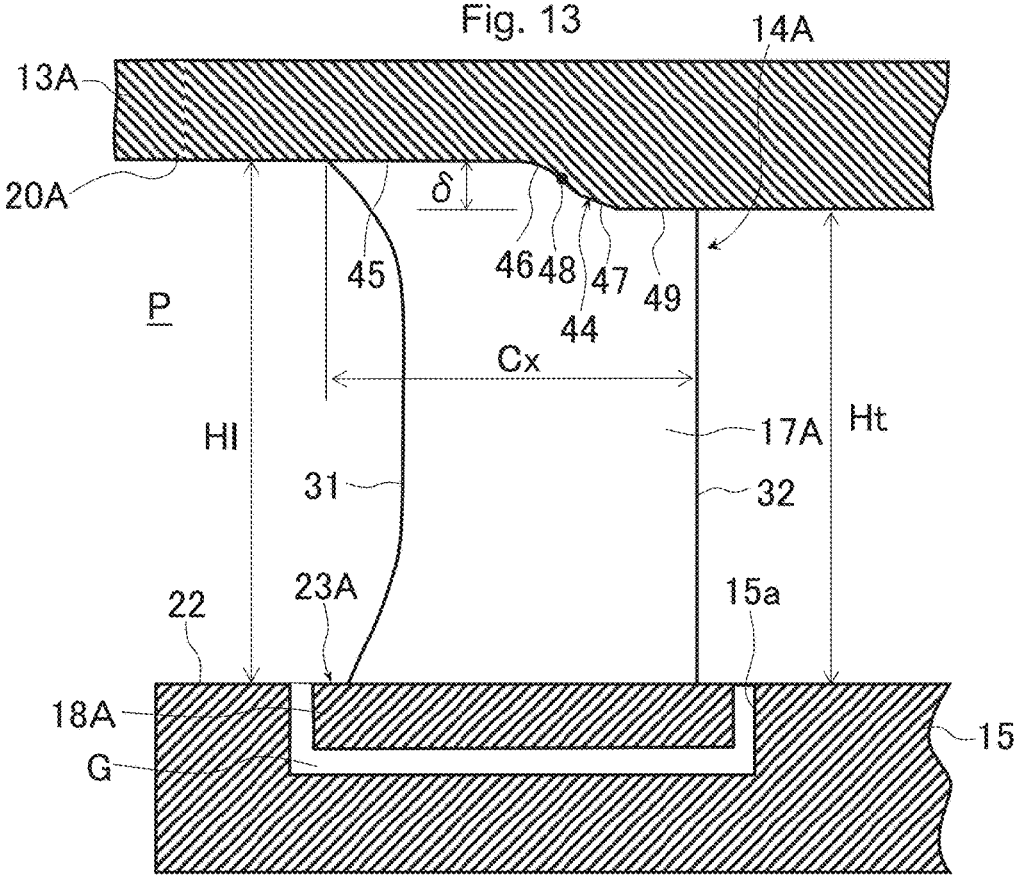
FIG. 13 is a meridional sectional view illustrating a stator blade and a wall surface of an annular channel configuring parts of an axial flow compressor and a gas turbine including the same according to a modification of the first embodiment of the present invention.

FIG. 13 is a meridional sectional view illustrating a stator blade and a wall surface of an annular channel configuring parts of the axial flow compressor and the gas turbine including the same according to the modification of the first embodiment of the present invention. FIG. 14 is a characteristic view illustrating a blade outlet angle distribution in the blade height direction in the stator blade configuring a part of the axial flow compressor according to the modification of the first embodiment of the present invention which is illustrated in FIG. 13 and the blade outlet angle distribution in the reference blade. In FIG. 14, the vertical axis HD indicates the dimensionless blade height, and the horizontal axis k2 indicates the blade outlet angle. In addition, the solid line I indicates a case according to the present embodiment, and the broken line R indicates a case of the reference blade. In FIGS. 13 and 14, the reference numerals which are the same as the reference numerals illustrated in FIGS. 1 to 12 indicate the same elements, and thus, detailed description thereof will be omitted.

In the axial flow compressor and the gas turbine including the same according to the modification example of the first embodiment of the present invention which is illustrated in FIG. 13, whereas the first embodiment is configured so that the wall surface on the inner peripheral side of the stator blade row 14 in the annular channel P (outer peripheral surface 23 of the blade tip shroud 18) protrudes to the annular channel P (refer to FIG. 3), an wall surface on an outer peripheral side of a stator blade row 14A in the annular channel P protrudes to the annular channel P.

Specifically, an arrangement portion of the stator blade row 14A on an inner peripheral surface 20A of a casing 13A, that is, the wall surface on the outer peripheral side of the stator blade row 14A in the annular channel P has a protruding portion 44 such that downstream side part of the arrangement portion on the inner peripheral surface 20A of the casing 13A is curved so as to further protrude to the annular channel P as much as δ than upstream side part. In other words, a meridional channel height Ht of the annular channel P at an outlet (trailing edge 32) of the stator blade row 14A is set to be further decreased as much as δ than a meridional channel height H1 at an inlet (leading edge 31) of the stator blade row 14A. A specific configuration of the arrangement portion of the stator blade row 14A on the inner peripheral surface 20A of the casing 13A includes a first cylindrical surface 45 which is smoothly connected to the inner peripheral surface 20A of the casing 13A on the upstream side from the stator blade row 14A, a first curved surface 46 which is smoothly connected to the first cylindrical surface 45 while being located on the downstream side of the first cylindrical surface 45 and which has a shape convex to the outside of the annular channel P, a second curved surface 47 which is smoothly connected to the first curved surface 46 while being located on the downstream side of the first curved surface 46 and which has a shape convex to the inside of the annular channel P, an inflection point 48 between the first curved surface 46 and the second curved surface 47, and a second cylindrical surface 49 which is smoothly connected to the second curved surface 47 while being located on the downstream side of the second curved surface 47. The second cylindrical surface 49 is located on the inner side in the radial direction as much as δ from the first cylindrical surface 45. It is preferable that a position of the inflection point 48 in the axial direction from the leading edge 31 is at a ratio approximately from 40% to 60% with respect to the axial chord length Cx. On the other hand, in a blade tip shroud 18A of the stator blade row 14A, an outer peripheral surface 23A thereof is formed into a cylindrical surface, and does not protrude to the annular channel P.

Figure 14:
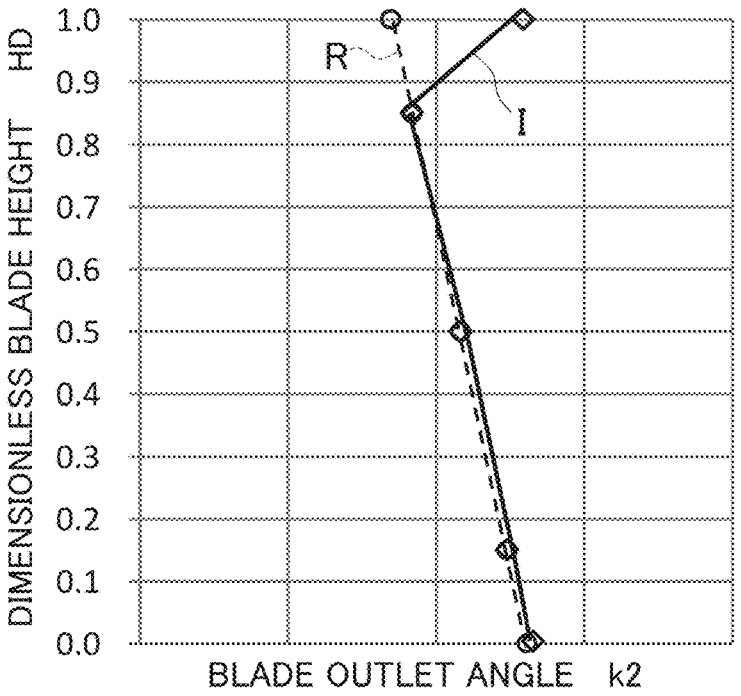
FIG. 14 is a characteristic view illustrating a blade outlet angle distribution in the blade height direction in the stator blade configuring a part of the axial flow compressor according to the modification of the first embodiment of the present invention which is illustrated in FIG. 13 and the blade outlet angle distribution in the reference blade.

In addition, as illustrated in FIG. 14, in the outer peripheral side end portion of the blade section 17A of the stator blade row 14A, the distribution in the blade height direction of the blade outlet angle k2 gradually increases in the outer peripheral end direction (outer peripheral side wall surface direction of the annular channel P). In addition, the distribution in the blade height direction of the blade outlet angle k2 in the blade height intermediate portion of the blade section 17A monotonously decreases in the outer peripheral end direction, for example. An increase rate in the outer peripheral end direction (outer peripheral side wall surface direction of the annular channel P) of the blade outlet angle k2 in the outer peripheral side end portion of the blade section 17A is set to be greater than an increase rate in the outer peripheral end direction of the blade outlet angle k2 in the blade height intermediate portion.

In the present embodiment, the downstream side part of the wall surface on the outer peripheral side of the stator blade row 14A in the annular channel P further protrudes to the annular channel P than the upstream side part. Accordingly, the deceleration of the flow is locally relieved in the downstream side portion on the outer peripheral side end portion of the stator blade row 14A where the corner stall is likely to occur. Therefore, the development of the boundary layer is restrained on the outer peripheral endwall of the stator blade row 14A. As a result, the corner stall can be restrained.

In addition, in the present embodiment, the increase rate in the outer peripheral end direction of the blade outlet angle in the outer peripheral side end portion of the blade section 17A is greater than that in the blade height intermediate portion of the blade section 17A. Accordingly, it is possible to restrain the outlet flow angle at the outlet of the stator blade row 14A from being excessively decreased due to the protruding outer peripheral side end wall surface of the annular channel P. Therefore, it is possible to optimize the inflow condition for the subsequent blade row (including a diffuser downstream of the final stage) of the stator blade row 14A.

According to the axial flow compressor and the gas turbine including the same according to the above-described modification of the first embodiment of present invention, it is possible to obtain an advantageous effect which is the same as that according to the above-described first embodiment.

[Second Embodiment]

Next, an axial flow compressor, a gas turbine including the same, and a stator blade of an axial flow compressor according to a second embodiment of the present invention will be described with reference to FIG. 15.

Figure 15:
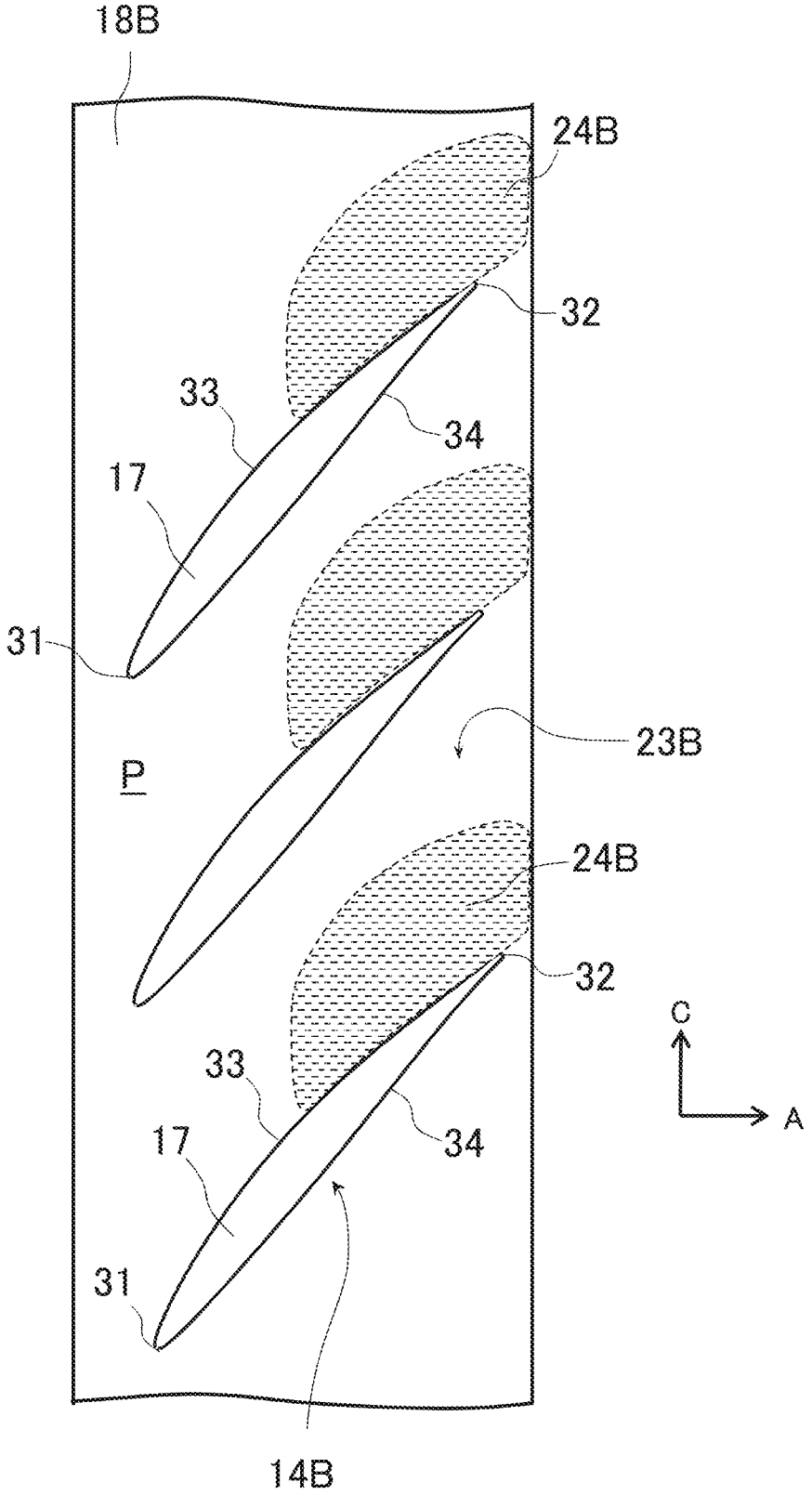
FIG. 15 is a view for describing a protruding portion of a wall surface on an inner peripheral side of an annular channel in an axial flow compressor, a gas turbine including the same, and a stator blade of an axial flow compressor according to a second embodiment of the present invention.

FIG. 15 is a view for describing a protruding portion of a wall surface on an inner peripheral side of an annular channel in the axial flow compressor, the gas turbine including the same, and the stator blade of the axial flow compressor according to the second embodiment of the present invention. In FIG. 15, the reference numerals which are the same as the reference numerals illustrated in FIGS. 1 to 14 indicate the same elements, and thus, detailed description thereof will be omitted.

In the axial flow compressor, the gas turbine including the same, and the stator blade of the axial flow compressor according to the second embodiment of the present invention which is illustrated in FIG. 15, whereas the first embodiment is configured so that the protruding portion 24 of the outer peripheral surface 23 (wall surface on the inner peripheral side of the stator blade row 14 in the annular channel P) of the blade tip shroud 18 of the stator blade row 14 is uniformly formed in the circumferential direction and the protruding portion 24 is axially symmetrical, a protruding portion 24B of an outer peripheral surface 23B (wall surface on the inner peripheral side of a stator blade row 14B in the annular channel P) of a blade tip shroud 18B of the stator blade row 14B is formed only in a region on the side of the suction surface 33 in the downstream side portion of the blade section 17 so as to be axially asymmetrical.

In the present embodiment, the protruding portion 24B on the outer peripheral surface 23B locally relieves the deceleration of the flow in the downstream side portion on the side of the suction surface 33 of the blade section 17 of the stator blade row 14B where the corner stall is likely to occur. This restrains the development of the boundary layer on the outer peripheral surface 23B (inner peripheral endwall of the stator blade row 14B). As a result, it is possible to avoid the corner stall.

On the other hand, the protruding portion is not formed in regions other than the downstream side portion on the side of the suction surface 33 of the blade section 17, thereby decreasing the portion protruding to the annular channel P. Accordingly, it is possible to further increase an outlet channel area between the blade sections 17 of the stator blade row 14B, compared to the case according to the first embodiment. Therefore, while the corner stall is avoided, the flow velocity is decreased at the outlet of the stator blade row 14B. Accordingly, it is possible to further decrease pressure loss.

According to the axial flow compressor, the gas turbine including the same, and the stator blade of the axial flow compressor according to the above-described second embodiment of the present invention, it is possible to obtain an advantageous effect which is the same as that according to the above-described first embodiment.

[Third Embodiment]

Next, an axial flow compressor and a gas turbine including the same according to a third embodiment of the present invention will be described with reference to FIGS. 16 and 17.

Figure 16:
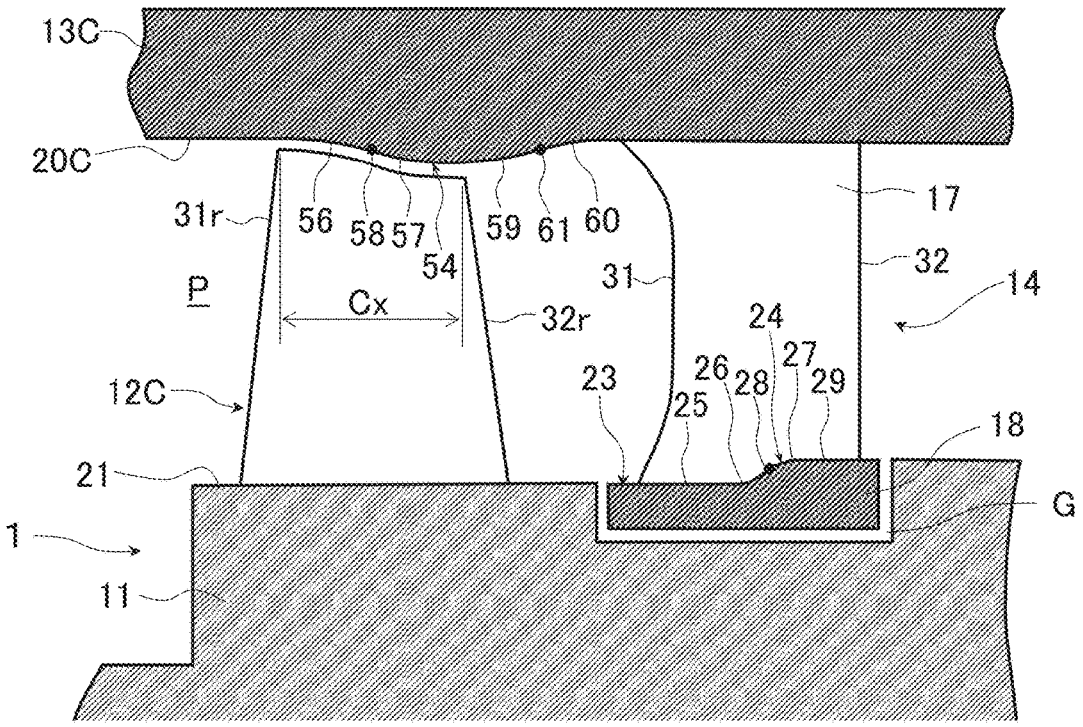
FIG. 16 is a meridional sectional view illustrating a main portion structure of an axial flow compressor and a gas turbine including the same according to a third embodiment of the present invention.

FIG. 16 is a meridional sectional view illustrating a main portion structure of the axial flow compressor and the gas turbine including the same according to the third embodiment of the present invention. FIG. 17 is a characteristic view illustrating a blade outlet angle distribution in a blade height direction in a rotor blade configuring a part of the axial flow compressor according to the third embodiment of the present invention which is illustrated in FIG. 16 and a blade outlet angle distribution in a reference blade. In FIG.

17, the vertical axis HD indicates the dimensionless blade height, and the horizontal axis k2 indicates the blade outlet angle. In addition, the solid line I indicates a case according to the present embodiment, and the broken line R indicates a case of the reference blade. In FIGS. 16 and 17, the reference numerals which are the same as the reference numerals illustrated in FIGS. 1 to 15 indicate the same elements, and thus, detailed description thereof will be omitted.

In the axial flow compressor and the gas turbine including the same according to the third embodiment of the present invention which is illustrated in FIG. 16, in addition to the structure of the stator blade row 14 according to the first embodiment, there is provided a structure in which downstream side part of a wall surface on an outer peripheral side of a rotor blade row 12C in the annular channel P further protrudes to the annular channel P than upstream side part of the wall surface on the outer peripheral side of the rotor blade row 12C.

Specifically, a portion facing a tip of the rotor blade row 12C on an inner peripheral surface 20C of a casing 13C, that is, the wall surface on the outer peripheral side of the rotor blade row 12C in the annular channel P has a protruding portion 54 such that the downstream side part of the portion facing the tip of the rotor blade row 12C is curved so as to further protrude to the annular channel P than the upstream side part of the portion. In other words, a meridional channel height of the annular channel P at an outlet (trailing edge 32*r*) of the rotor blade row 12C is set to be further decreased than a meridional channel height at an inlet (leading edge 31*r*) of the rotor blade row 12C. A specific configuration of the portion facing the tip of the rotor blade row 12C on the inner peripheral surface 20C of the casing 13C includes a first curved surface 56 which is smoothly connected to the inner peripheral surface 20C of the casing 13C on the upstream side from the rotor blade row 12C and which has a shape convex to the outside of the annular channel P, a second curved surface 57 which is smoothly connected to the first curved surface 56 while being located on the downstream side of the first curved surface 56 and which has a shape convex to the inside of the annular channel P, and a first inflection point 58 between the first curved surface 56 and the second curved surface 57. It is preferable that the position of the first inflection point 58 in the axial direction from the leading edge 31*r* is at a ratio approximately from 40% to 60% with respect to the axial chord length Cx.

Furthermore, a portion on the downstream side from the trailing edge 32*r* of the rotor blade row 12C on the inner peripheral surface 20C of the casing 13C is formed into a curved surface which increases the meridional channel height decreased at the outlet of the rotor blade row 12C. A specific configuration of the portion has a third curved surface 59 which is smoothly connected to the second curved surface 57 while being located on the downstream side of the second curved surface 57 and which has a shape convex to the inside of the annular channel P, a fourth curved surface 60 which is smoothly connected to the third curved surface 59 while being located on the downstream side of the third curved surface 59 and which has a shape convex to the outside of the annular channel P, and a second inflection point 61 between the third curved surface 59 and the fourth curved surface 60.

A blade tip clearance is disposed between the tip of the rotor blade row 12C and the inner peripheral surface 20C of the casing 13C. The blade tip clearance is disposed in order to avoid the rotor blade row 12C from coming into contact with the inner peripheral surface 20C of the casing 13C. In order to decrease the leakage flow of the working fluid from the blade tip clearance, each tip surface of the rotor blades of the rotor blade row 12C is a curved surface in accordance with the protruding shape of the inner peripheral surface 20C of the casing 13C. That is, the tip surface of the rotor blade has a shape in which the downstream side part is further recessed than the upstream side part.

Figure 17:
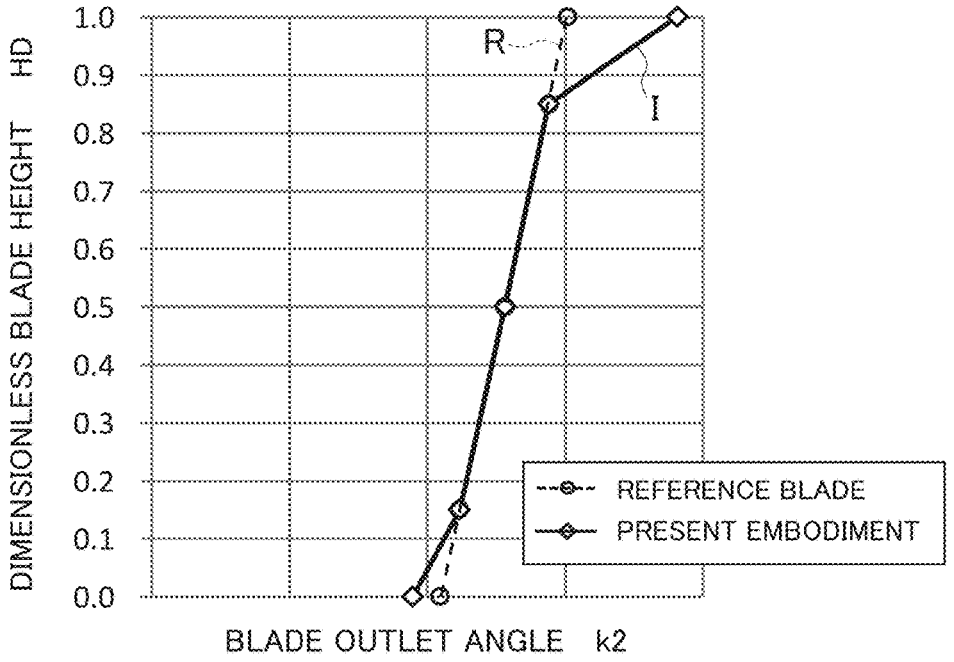
FIG. 17 is a characteristic view illustrating a blade outlet angle distribution in a blade height direction in a rotor blade configuring a part of the axial flow compressor according to the third embodiment of the present invention which is illustrated in FIG. 16 and a blade outlet angle distribution in a reference blade.

In addition, as illustrated in FIG. 17, a tip portion (dimensionless blade height HD is approximately 0.85 to 1.0; blade end portion on an outer peripheral side) of each rotor blade of the rotor blade row 12C is set such that the blade outlet angle k2 is larger than the blade outlet angle k2 of the blade height intermediate portion (dimensionless blade height HD is approximately 0.15 to 0.85). Furthermore, the distribution in the blade height direction of the blade outlet angle k2 in the tip portion of the rotor blade gradually increases in the tip direction (outer peripheral side wall surface direction of the annular channel P). In addition, the distribution in the blade height direction of the blade outlet angle k2 in the blade height intermediate portion of the rotor blade monotonously increases in the tip direction, for example. An increase rate in the tip direction (outer peripheral side wall surface direction of the annular channel P) of the blade outlet angle k2 in the tip portion of the rotor blade is set to be greater than an increase rate in the tip direction of the blade outlet angle k2 in the blade height intermediate portion of the rotor blade.

In the present embodiment, the meridional channel height in the upstream side portion of the rotor blade row 12C where the flow is accelerated is maintained to be substantially constant, thereby relieving the acceleration of the flow. As a result, the pressure loss caused by friction against the blade surface of the rotor blade row 12C is restrained. On the other hand, the downstream side portion of the portion (wall surface on the outer peripheral side of the rotor blade row 12C in the annular channel P) facing the tip of the rotor blade row 12C on the inner peripheral surface 20C of the casing 13C protrudes to the annular channel P. In this manner, the meridional channel height in the downstream side portion of the rotor blade row 12C where the flow is greatly decelerated is further decreased than the meridional channel height in the upstream side portion of the rotor blade row 12C. Accordingly, the deceleration of the flow of the boundary layer is locally relieved on the wall surface on the outer peripheral side of the rotor blade row 12C in the annular channel P. This restrains the development of the boundary layer on the wall surface on the outer peripheral side. As a result, it is possible to restrain the corner stall.

In addition, in the present embodiment, an increase rate in the blade height increasing direction of the blade outlet angle in the tip portion of the rotor blade of the rotor blade row 12C is set to be greater than that in the blade height intermediate portion of the rotor blade. Therefore, the flow is less turned in the vicinity of the wall surface on the outer peripheral side of the rotor blade row 12C in the annular channel P in which the flowing direction in the boundary layer tends to be greatly deviated from the main stream due to the influence of the upstream blade row (stator blade row which is not illustrated), thereby restraining the flow separation from occurring on the wall surface on the outer peripheral side. In addition, the increased blade outlet angle in the tip portion of the rotor blade restrains the outlet flow angle from being excessively decreased in the vicinity of the wall surface on outer peripheral side due to the protruding wall surface on the outer peripheral side. As a result, there is a tendency that a flowing direction downstream of the rotor blade row 12C is optimized or uniformized.

Furthermore, in the present embodiment, the portion on the downstream side from the trailing edge 32*r* of the rotor blade row 12C on the inner peripheral surface 20C of the casing 13C is curved, and the meridional channel height at the inlet (leading edge 31) of the stator blade row 14 on the downstream side of the rotor blade row 12C is set to be higher than the meridional channel height at the outlet (trailing edge 32*r*) of the rotor blade row 12C, thereby decreasing the velocity of the flow into the subsequent stator blade row 14. In this manner, it is possible to decrease the loss of the overall compressor.

In addition, in the present embodiment, in a case where the protruding shape of the portion facing the rotor blade row 12C on the inner peripheral surface 20C of the casing 13C is applied to an existing axial flow compressor, the meridional channel height decreased by the protruding inner peripheral surface 20C at the outlet of the rotor blade row is restored so as to match a meridional channel height at an inlet of an existing subsequent stator blade row. Accordingly, it is not necessary to redesign subsequent blade rows except for the rotor blade row to which the protruding shape is applied.

According to the axial flow compressor and the gas turbine including the same according to the third embodiment of the present invention, similarly to the above-described first embodiment, the corner stall of the rotor blade row 12C is restrained, and concurrently, the inflow condition for the subsequent stator blade row 14 can be optimized. As a result, it is possible to realize improved efficiency and ensured reliability of the overall compressor.

[Modification of Third Embodiment]

Next, an axial flow compressor and a gas turbine including the same according to a modification of the third embodiment of the present invention will be described with reference to FIGS. 18 and 19.

Figure 18:
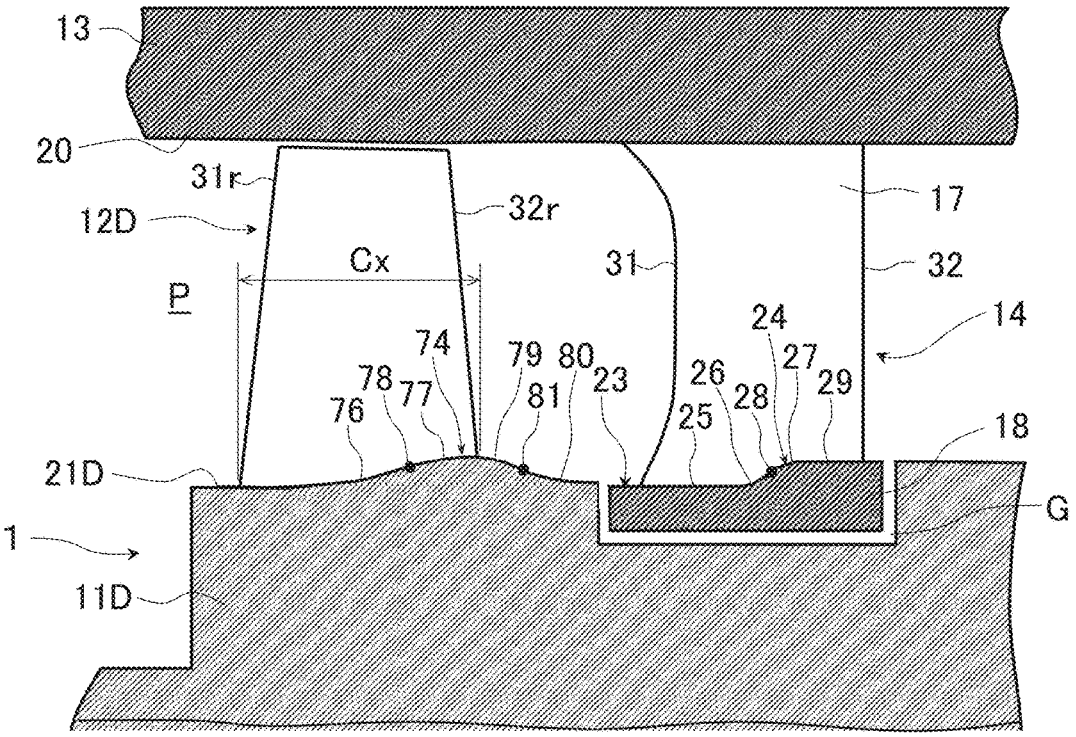
FIG. 18 is a meridional sectional view illustrating a main portion structure of an axial flow compressor and a gas turbine including the same according to a modification of the third embodiment of the present invention.

FIG. 18 is a meridional sectional view illustrating a main portion structure of the axial flow compressor and the gas turbine including the same according to the modification of the third embodiment of the present invention. FIG. 19 is a characteristic view illustrating a blade outlet angle distribution in the blade height direction in a rotor blade configuring a part of the axial flow compressor according to the modification of the third embodiment of the present invention which is illustrated in FIG. 18 and the blade outlet angle distribution in the reference blade. In FIG. 19, the vertical axis HD indicates the dimensionless blade height, and the horizontal axis k2 indicates the blade outlet angle. In addition, the solid line I indicates a case according to the present embodiment, and the broken line R indicates a case of the reference blade. In FIGS. 18 and 19, the reference numerals which are the same as the reference numerals illustrated in FIGS. 1 to 17 indicate the same elements, and thus, detailed description thereof will be omitted.

In the axial flow compressor and the gas turbine including the same according to the modification of the third embodiment of the present invention which is illustrated in FIG. 18, whereas the third embodiment is configured such that the wall surface on the outer peripheral side of the rotor blade row 12C in the annular channel P (portion facing the tip of the rotor blade row 12C on the inner peripheral surface 20C of the casing 13C) protrudes to the annular channel P (refer to FIG. 16), a wall surface on an inner peripheral side of a rotor blade row 12D in the annular channel P protrudes to the annular channel P.

Specifically, an arrangement portion of the rotor blade row 12D on an outer peripheral surface 21D of a rotor 11D, that is, the wall surface on the inner peripheral side of the rotor blade row 12D in the annular channel P has a protruding portion 74 such that the downstream side part of the arrangement portion of the rotor blade row 12D is curved so as to further protrude to the annular channel P than the upstream side part of the arrangement portion. In other words, the meridional channel height of the annular channel P at the outlet (trailing edge 32*r*) of the rotor blade row 12D is set to be further decreased than the meridional channel height at the inlet (leading edge 31*r*) of the rotor blade row 12D. A specific configuration of the arrangement portion of the rotor blade row on the outer peripheral surface 21D of the rotor 11D includes a first curved surface 76 which is smoothly connected to the outer peripheral surface 21D of the rotor 11D on the upstream side from the rotor blade row 12D and which has a shape convex to the outside of the annular channel P, a second curved surface 77 which is smoothly connected to the first curved surface 76 while being located on the downstream side of the first curved surface 76 and which has a shape convex to the inside of the annular channel P, and a first inflection point 78 between the first curved surface 76 and the second curved surface 77. It is preferable that the position of the first inflection point 78 in the axial direction from the leading edge 31*r* is at a ratio approximately from 40% to 60% with respect to the axial chord length Cx.

Furthermore, a portion on the downstream side from the trailing edge 32*r* of the rotor blade row 12D on the outer peripheral surface 21D of the rotor 11D is formed into a curved surface which increases the meridional channel height decreased in the arrangement portion of the rotor blade row 12D. A specific configuration of the portion on the downstream side from the trailing edge 32*r* of the rotor blade row 12D has a third curved surface 79 which is smoothly connected to the second curved surface 77 while being located on the downstream side of the second curved surface 77 and which has a shape convex to the inside of the annular channel P, a fourth curved surface 80 which is smoothly connected to the third curved surface 79 while being located on the downstream side of the third curved surface 79 and which has a shape convex to the outside of the annular channel P, and a second inflection point 81 between the third curved surface 79 and the fourth curved surface 80.

Figure 19:
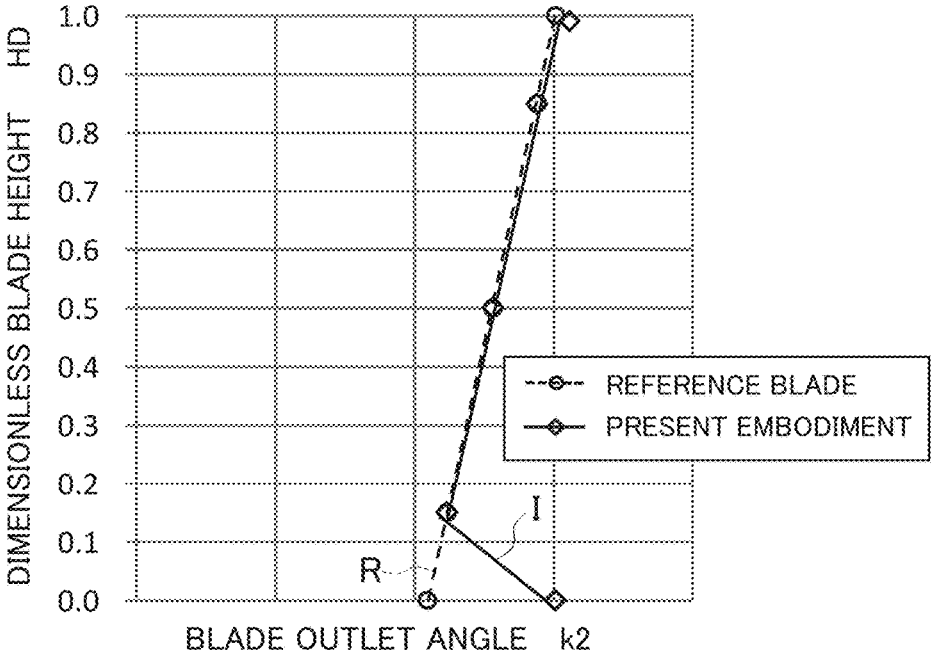
FIG. 19 is a characteristic view illustrating a blade outlet angle distribution in the blade height direction in a rotor blade configuring a part of the axial flow compressor according to the modification of the third embodiment of the present invention which is illustrated in FIG. 18 and the blade outlet angle distribution in the reference blade.

In addition, as illustrated in FIG. 19, in a hub portion (dimensionless blade height HD is 0.0 to approximately 0.15; blade end portion on an inner peripheral side) of each rotor blade of the rotor blade row 12D, a distribution in the blade height direction of the blade outlet angle k2 gradually increases in a hub direction (inner peripheral side wall surface direction of the annular channel P). In addition, a distribution in the blade height direction of the blade outlet angle k2 in the blade height intermediate portion of the rotor blade monotonously decreases in the hub direction, for example. An increase rate in the hub direction (inner peripheral side wall surface direction of the annular channel P) of the blade outlet angle k2 in the hub portion of the rotor blade is set to be greater than an increase rate in the hub direction of the blade outlet angle k2 in the blade height intermediate portion of the rotor blade.

In the present embodiment, the downstream side part of the wall surface on the inner peripheral side of the rotor blade row 12D in the annular channel P further protrudes to the annular channel P than the upstream side part. In this manner, the deceleration of the flow is locally relieved in the downstream side portion on the hub portion of the rotor blade row 12D where the corner stall is likely to occur. Therefore, the development of the boundary layer is restrained on the wall surface on the inner peripheral side of the rotor blade row 12D. As a result, the corner stall can be restrained.

In addition, in the present embodiment, the increase rate in the hub direction (inner peripheral side wall surface direction of the annular channel P) of the blade outlet angle in the hub portion of the rotor blade row 12D is greater than that in the blade height intermediate portion of the rotor blade row 12D. Accordingly, the outlet flow angle is restrained from being excessively decreased at the outlet of the rotor blade row 12D due to the protruding wall surface on the inner peripheral side of the annular channel P. Therefore, it is possible to optimize the inflow condition for the subsequent stator blade row 14 of the rotor blade row 12D.

According to the axial flow compressor and the gas turbine including the same according to the above-described modification of the third embodiment of the present invention, it is possible to obtain an advantageous effect which is the same as that according to the above-described third embodiment.

As described above, according to the axial flow compressor and the gas turbine including the same according to the embodiments of the present invention, the downstream side of the portion of the wall surface 20A, 20C, 21D, 23, and 23B of the annular channel P where at least any one blade row of the rotor blade rows 12C and 12D and the stator blade rows 14, 14A, and 14B is located further protrudes to the annular channel P than the upstream side of the portion. Accordingly, development of the boundary layer on the wall surface 20A, 20C, 21D, 23, and 23B of the channel P is locally restrained. Therefore, it is possible to restrain flow separation (corner stall) in the corner portion formed between the blade surface of the blade rows 12C, 12D, 14, 14A, and 14B and the wall surfaces 23, 20A, 23B, 20C, and 21D of the channel P. Furthermore, the increase rate in the wall surface direction of the blade outlet angle in the blade end portion on the side of the wall surface having the protruding portion is set to be greater than the increase rate of the blade outlet angle in the blade height intermediate portion. Accordingly, it is possible to restrain the outlet flow angle of the flow at the outlet of the blade rows 12C, 12D, 14, 14A, and 14B from being excessively decreased due to the protruding portion of the channel wall surfaces 20A, 20C, 21D, 23, and 23B. Therefore, it is possible to optimize the inflow condition for the subsequent blade row. As a result, it is possible to realize improved efficiency and ensured reliability of the overall compressor.

[Another Embodiment]

In the above-described first and second embodiments and the modification thereof, an example has been described where the present invention is applied to a configuration in which the inner peripheral side casing 15 functioning as a stationary member is arranged on the inner peripheral side of the blade tip shrouds 18, 18A, and 18B of the stator blade rows 14, 14A, and 14B by leaving the gap G therebetween on the assumption of the final stage. However, the present invention is also applicable to a configuration in which the blade tip shroud of the stator blade row faces the rotor 11 functioning as a rotary member. Even in this case, a situation where the gap is present between the blade tip shroud and the rotor 11 is not changed. The boundary layer in the vicinity of the inner peripheral side wall surface of the annular channel P receives the influence due to the leakage flow from the gap. Therefore, the present invention provides effective means for restraining the corner stall.

In addition, in the above-described first embodiment and the modification thereof, an example has been described where the wall surfaces 23 and 20A on the inner peripheral side or the outer peripheral side of the stator blade rows 14 and 14A in the annular channel P are configured to include the first cylindrical surfaces 25 and 45, the first curved surfaces 26 and 46 which are smoothly connected to the first cylindrical surfaces 25 and 45, the second curved surfaces 27 and 47 which are smoothly connected to the first curved surfaces 26 and 46, the inflection points 28 and 48 between the first curved surfaces 26 and 46 and the second curved surfaces 27 and 47, and the second cylindrical surfaces 29 and 49 which are smoothly connected to the second curved surfaces 27 and 47. However, as long as the downstream side part of the wall surfaces of the stator blade rows 14 and 14A in the annular channel P has a shape further protruding to the annular channel P than the upstream side part, the wall surfaces of the stator blade rows 14 and 14A can also be configured to include at least the first curved surfaces 26 and 46, the second curved surfaces 27 and 47 which are smoothly connected to the first curved surfaces, and the inflection points 28 and 48 between the first curved surfaces 26 and 46 and the second curved surfaces 27 and 47.

In the above-described third embodiment, an example has been described where the present invention is applied to the rotor blade row 12C having no shroud. That is, the tip surfaces of the rotor blades of the rotor blade row 12C are formed into the curved surfaces corresponding to the protruding shape of the inner peripheral surface 20C of the casing 13C. The present invention is also applicable to a rotor blade row which has a shroud at the tip. In this case, the outer peripheral surface of the shroud is formed into a curved surface corresponding to the protruding shape of the inner peripheral surface 20C of the casing 13C.

In addition, the present invention is not limited to the first to third embodiments and the modifications thereof described above, but may include various other modifications. The above embodiments and modifications are described in detail in order to facilitate the understanding of the present invention, and the present invention is not limited to those which necessarily include all of the above-described configurations. For example, a configuration of a certain embodiment can be partially replaced with a configuration of another embodiment. In addition, a configuration of a certain embodiment can be added to a configuration of another embodiment. In addition, a configuration of each embodiment can be partially added to, deleted from, or replaced with another configuration.

What is claimed is:

1. An axial flow compressor comprising:

multiple rotor blade rows configured to include multiple rotor blades and multiple stator blade rows configured to include multiple stator blades, the multiple rotor blades and the multiple stator blades being arranged inside an annular channel through which a working fluid flows, wherein a first portion of at least one wall surface on an inner peripheral side and an outer peripheral side of the annular channel has a protruding portion such that downstream side part of the first portion is curved so as to further protrude to the annular channel than upstream side part of the first portion, where the first portion is disposed in a place where at least one of the rotor blade rows and the stator blade rows is located, and wherein each of the multiple rotor and stator blades located at the protruding portion of the wall surface is configured such that a blade outlet angle in a blade height portion monotonously changes toward the wall surface having the protruding portion and an increase rate of a blade outlet angle at a blade end on a side of the wall surface having the protruding portion is greater than an increase rate of the blade outlet angle in the blade height portion.

2. The axial flow compressor according to claim 1, wherein the protruding portion is formed in a circumferential direction of the annular channel.

3. The axial flow compressor according to claim 1, wherein the protruding portion is formed only in a region on a suction surface side of the each of the multiple rotor and stator blades.

4. The axial flow compressor according to claim 2, wherein the first portion of the wall surface having the protruding portion includes:

a first curved surface, a second curved surface located on a downstream side of the first curved surface, the second curved surface having a shape convex to an inside of the annular channel, and a first inflection point between the first curved surface and the second curved surface.

5. The axial flow compressor according to claim 4, wherein the first inflection point is located in any range from 40% to 60% of an axial chord length of the blade end and is located on the side of the wall surface having the protruding portion from a leading edge of the blade, where the axial chord length is a length in an axial direction of a chord line.

6. The axial flow compressor according to claim 4, wherein a portion on the downstream side from the blade row on the wall surface having the protruding portion includes:

a third curved surface connected to the second curved surface, the third curved surface having a shape convex to the inside of the annular channel, a fourth curved surface located on the downstream side of the third curved surface, and a second inflection point between the third curved surface and the fourth curved surface.

7. The axial flow compressor according to claim 1, wherein the blade is configured such that an axial chord length of the blade end is longer than an axial chord length of the blade height portion, where the axial chord length is a length in an axial direction of a chord line.

8. The axial flow compressor according to claim 1, wherein at least one of the multiple stator blades comprises:

a blade section having an airfoil-shaped cross section, and a blade tip shroud disposed on an inner peripheral end of the blade section, wherein an outer peripheral surface of the blade tip shroud configures the wall surface having the protruding portion on the inner peripheral side of the annular channel, and wherein a stationary member or a rotary member is arranged on an inner peripheral side of the blade tip shroud.

9. A gas turbine comprising the axial flow compressor according to claim 1.

10. A stator blade which configures a part of a stator blade row of an axial flow compressor, the stator blade comprising:

a blade section having an airfoil-shaped cross section; and a blade tip shroud disposed on an inner peripheral end of the blade section, wherein an outer peripheral surface of the blade tip shroud has a protruding portion such that downstream side part of the outer peripheral surface is curved so as to further protrude to a blade section side than upstream side part of the outer peripheral surface, and wherein the blade section is configured such that a blade outlet angle in a blade height portion monotonously changes toward the wall surface having the protruding portion and an increase rate of a blade outlet angle in an inner peripheral end direction in an inner peripheral side end portion is greater than an increase rate of the blade outlet angle in the inner peripheral end direction in the blade height portion.

* * * * *